US011018430B2

(12) United States Patent
Kildal et al.

(10) Patent No.: US 11,018,430 B2
(45) **Date of Patent: *May 25, 2021**

(54) SELF-GROUNDED SURFACE MOUNTABLE BOWTIE ANTENNA ARRANGEMENT, AN ANTENNA PETAL AND A FABRICATION METHOD

(71) Applicant: GAPWAVES AB, Göteborg (SE)

(72) Inventors: Per-Simon Kildal, Pixbo (SE); Sadegh Mansouri Moghaddam, Gothenburg (SE); Andrés Alayon Glazunov, Upplands Väsby (SE)

(73) Assignee: GAPWAVES AB, Gothenburg (SE)

( * ) Notice: Subject to any disclaimer, the term of this patent is extended or adjusted under 35 U.S.C. 154(b) by 0 days.

This patent is subject to a terminal disclaimer.

(21) Appl. No.: 15/776,959

(22) PCT Filed: Mar. 14, 2016

(86) PCT No.: PCT/SE2016/050207

§ 371 (c)(1),
(2) Date: May 17, 2018

(87) PCT Pub. No.: WO2017/086855

PCT Pub. Date: May 26, 2017

(65) Prior Publication Data

US 2018/0358706 A1 Dec. 13, 2018

(30) Foreign Application Priority Data

Nov. 17, 2015 (WO) ..... PCT/SE2015/051231
Dec. 8, 2015 (WO) ..... PCT/SE2015/051315

(51) Int. Cl.
*H01Q 9/28* (2006.01)
*H01Q 1/48* (2006.01)
(Continued)

(52) U.S. Cl.
CPC ..... *H01Q 9/26* (2013.01); *H01Q 1/246* (2013.01); *H01Q 1/48* (2013.01); *H01Q 9/28* (2013.01);
(Continued)

(58) Field of Classification Search
None
See application file for complete search history.

(56) References Cited

U.S. PATENT DOCUMENTS 5,325,105 A 6/1994 Cermignani et al.
6,590,541 B1 * 7/2003 Schultze ..... H01Q 1/36 343/741
(Continued)

FOREIGN PATENT DOCUMENTS

CN 101013772 A 8/2007
CN 104597442 A 5/2015
(Continued)

OTHER PUBLICATIONS

Win M. Z. et al."History and Applications of UWB" Proceedings of the IEEE, vol. 97, No. 2, Feb. 2009, pp. 198-204.
(Continued)

*Primary Examiner* — Trinh V Dinh
(74) *Attorney, Agent, or Firm* — Buchanan Ingersoll & Rooney P.C.

(57) ABSTRACT

A self-grounded bowtie antenna arrangement including an antenna structure including a number of antenna petals including arm sections tapering towards a respective end tip portion and being made of an electrically, conducting material, the end tip portions being arranged to approach a base portion on a first side thereof and to be connected to feeding ports, a specific port being provided for each antenna petal. The base portion includes a conducting ground plane or a Printed Circuit Board, and each antenna petal is made in one
(Continued)

piece from a metal sheet or similar, and it is adapted to be fabricated as separate units, and to be mountable onto a front or back side of the base portion or ground plane by means of surface mounting. The ground plane may be a Printed Circuit Board, meaning that the bowties can be mounted by automatic placement and soldering machines.

34 Claims, 24 Drawing Sheets

(51) Int. Cl.

| | |
|---|---|
| ***H01Q 9/26*** | (2006.01) |
| ***H01Q 21/06*** | (2006.01) |
| ***H01Q 21/26*** | (2006.01) |
| ***H01Q 1/24*** | (2006.01) |
| ***H01Q 21/24*** | (2006.01) |
| *H01Q 5/25* | (2015.01) |
| *H01Q 21/00* | (2006.01) |

(52) U.S. Cl.
CPC ..... *H01Q 21/06* (2013.01); *H01Q 21/062* (2013.01); *H01Q 21/24* (2013.01); *H01Q 21/26* (2013.01); *H01Q 5/25* (2015.01); *H01Q 21/0025* (2013.01); *H01Q 21/0087* (2013.01)

(56) References Cited

U.S. PATENT DOCUMENTS

| | | | | |
|---|---|---|---|---|
| 9,935,373 | B2 * | 4/2018 | Yang | H01Q 9/28 |
| 2004/0095290 | A1 | 5/2004 | Chen | |
| 2005/0078043 | A1 | 4/2005 | Apostolos et al. | |
| 2005/0146480 | A1 * | 7/2005 | Yazdandoost | H01Q 9/285 343/795 |
| 2005/0200549 | A1 * | 9/2005 | Thompson | H01Q 9/28 343/795 |
| 2006/0018147 | A1 * | 1/2006 | Kolar | G11C 11/412 365/154 |
| 2006/0181475 | A1 * | 8/2006 | Kwon | H01Q 7/00 343/793 |
| 2007/0210976 | A1 | 9/2007 | Luk et al. | |
| 2008/0150833 | A1 | 6/2008 | Huang et al. | |
| 2014/0071006 | A1 | 3/2014 | Chan et al. | |
| 2014/0218254 | A1 | 8/2014 | Kitchener | |
| 2015/0162665 | A1 | 6/2015 | Boryssenko et al. | |
| 2015/0349435 | A1 * | 12/2015 | Xue | H01Q 21/29 343/726 |
| 2015/0380826 | A1 | 12/2015 | Yang et al. | |
| 2018/0337461 | A1 * | 11/2018 | Kildal | H01Q 9/28 |

FOREIGN PATENT DOCUMENTS

| | | | | |
|---|---|---|---|---|
| CN | 105027353 | A | 11/2015 | |
| EP | 2 727 183 | | 5/2014 | |
| JP | 3041690 | U | 7/1997 | |
| JP | 3096347 | U | 6/2003 | |
| JP | 2007324824 | A | 12/2007 | |
| JP | 2015-531577 | A | 11/2015 | |
| SE | 1001072 | A1 | 5/2012 | |
| SE | 2015/051231 | * | 11/2015 | H01Q 9/26 |
| WO | 01/41256 | A1 | 6/2001 | |
| WO | 201300519 | A2 | 1/2013 | |
| WO | WO 2014/062112 | A1 | 4/2014 | |
| WO | 2015169394 | A1 | 11/2015 | |

OTHER PUBLICATIONS

Amert A. k. et al."Miniaturization of the Biconical Antenna for Ultrawideband Applications"IEEE Transactions on Antennas and Propagation, vol. 57, No. 12, Dec. 2009, pp. 3728-3735.

Mushiake Y."Self-Complementary Antennas" IEEE Antennas and Propagation Magazine, vol. 34, No. 6, Dec. 1992, pp. 23-29.

The Vivaldi Aerial, P. J. Gibson, Proc. 9th European Microwave Conference, pp. 101-105, 1979.

Kildal P."Preparing for GBitls coverage in 5G: Massive MIMO, PMC packaging by gap waveguides, OTA testing in random-LOS" Chalmers University of Technology, 7 pages.

International Search Report (PCT/ISA/210) dated Jul. 28, 2016, by the Swedish Patent Office as the International Searching Authority for International Application No. PCT/SE2016/050207.

Lestari et al., "A Modified Bow-Tie Antenna for Improved Pulse Radiation", IEEE Transactions on Antennas and Propagation, vol. 58, No. 7, Jul. 2010, pp. 2184-2192.

Raza et al., "Wideband Compact 4-port Dual Polarized Self-grounded Bowtie Antenna", IEEE Transactions on Antennas and Propagation, vol. 62, No. 9, Sep. 2014, 7 pages.

Extended European Search Report dated May 20, 2019, issued by the European Patent Office in corresponding European Application No. 18666743.4-1205 (9 pages).

Office Action (Communication pursuant to Article 94(3) EPC) dated Jun. 3, 2020, by the European Patent Office in corresponding European Application No. 16 866 743.4-1205. (7 pages).

Office Action (Notice of Reasons for Rejection) dated Feb. 21, 2020, by the Japanese Patent Office in corresponding Japanese Patent Application No. 2018-524429, and an English Translation of the Office Action. (18 pages).

* cited by examiner

SELF-GROUNDED SURFACE MOUNTABLE BOWTIE ANTENNA ARRANGEMENT, AN ANTENNA PETAL AND A FABRICATION METHOD

TECHNICAL FIELD

The present invention relates to a self-grounded antenna arrangement, as well as a method for producing a self-grounded antenna arrangement.

BACKGROUND

There is an increasing demand for wideband antennas for use within wireless communication, in order to allow communication in several frequency bands, the use of high or very high data rates and for different systems. Ultra Wide Band (UWB) signals are generally defined as signals having a large relative bandwidth (bandwidth divided by carrier frequency) or a large absolute bandwidth. The expression UWB is particularly used for the frequency band 3.2-10.6 GHz, but also for other and wider frequency bands.

The use of wideband signals is for example described in "History and applications of UWB", y M. Z. Win et. al, Proceedings of the IEEE, vol. 97, No. 2, p. 198-204, February 2009.

UWB-technology is a low cost technology. Development of CMOS processors transmitting and receiving UWB-signals has opened up for a large field of different applications and they can be fabricated at a very low cost for UWB-signals without requiring any hardware for mixers, RF (Radio Frequency)-oscillators or PLLs (Phase Locked Loops).

UWB technology can be implemented in a wide range of areas, for different applications, such as for example short range communication (less than 10 m) with very high data rates (up to or above 500 Mbps), e.g. for wireless USB similar communication between components in entertainment systems such as DVD players, TV and similar; in sensor networks where low data rate communication is combined with precise ranging and geolocation, and radar systems with extremely high spatial resolution and obstacle penetration capabilities, and generally for wireless communication devices.

To generate, transmit, receive and process UWB signals, the development of new techniques and arrangements within the fields of generation of signals, signal transmission, signal propagation, signal processing and system architectures is required.

Generally UWB antennas have been divided into four different categories of which the first category, the scaled category, comprises bowtie dipoles, see for example "A modified Bow-Tie antenna for improved pulse radiation", by Lestari et. al, IEEE Trans. Antennas Propag., Vol. 58, No. 7, pp. 2184-2192, July 2010, and biconical dipoles as for example discussed in "Miniaturization of the biconical Antenna for ultra-wideband applications" by A. K. Amert et. al, IEEE Trans. Antennas Propag., Vol. 57, No. 12, pp. 3728-3735, December 2009. The second category comprises self-complementary structures as e.g. described in "Self-complementary antennas" by Y. Mushiake, IEEE Antennas Propag. Mag., vol. 34, No. 6, pp. 23-29, December 1992. The third category comprises travelling wave structure antennas, e.g. the Vivaldi antenna as e.g. discussed in "The Vivaldi aerial" by P. J. Gibson, Proc. $9^{th}$ European Microwave conference, pp. 101-105, 1979, and the fourth category comprises multiple resonance antennas like log-periodic dipole antenna arrays.

Antennas from the scaled category, the self-complementary category and the multiple reflection category comprise compact, low profile antennas with low gain, i.e. having wide and often more or less omni-directional far field patterns, whereas antennas of the travelling wave category, like the Vivaldi antennas, are directional.

The above-mentioned UWB antennas were mainly designed for use in normal Line-of-Sight (LOS) antenna systems with one port per polarization and a known direction of the single wave between the transmitting and receiving side of the communication system.

In most environments, however, there are several objects (such as houses, trees, vehicles, humans) between the transmitting and receiving sides of the communication systems that cause reflections and scattering of the waves, resulting in a multiple of incoming waves on the receiving side, which has as a consequence that there was a need for antennas better accounting for these factors. Interference between these waves causes large level variations known as fading of the received voltage (known as the channel) at the port of the receiving antenna. This fading can be counteracted in modern digital communication systems making use of multiport antennas and support MIMO technology (multiple-input multiple-output).

Wireless communication systems may comprise a large number of micro base stations with multiband multiport antennas enabling MIMO with high requirements as to compactness, angular coverage, radiation efficiency and polarization schemes, which all are critical issues for the performance of such systems. The radiation efficiency of a multiport antenna is reduced by ohmic losses and impedance mismatch like in single-port antennas, but also by mutual coupling between the antenna ports.

Earlier known wideband antenna arrangements did not satisfactorily meet these requirements.

In WO2014/062112, though, a wideband compact multiport antenna suitable for MIMO communication systems as described above is disclosed, which has low ohmic losses, i.e. high radiation efficiency, good matching as well as low coupling between antenna ports. The geometry shown in FIG. 11 of WO2014/062112 is known as a dual-polarized self-grounded bowtie antenna, and is described in H. Raza, A. Hussain, J. Yang and P.-S. Kildal, "Wideband Compact 4-port Dual Polarized Self-grounded Bowtie Antenna", IEEE Transactions on Antennas and Propagation, Vol. 62, No., pp. 1-7, September 2014. The geometry of the self-grounded bowtie antenna is expensive to manufacture in large volumes, and in particular to mass produce.

For future wireless communication systems, such as e.g. the fifth wireless generation (5G), the frequencies used may be up to 30 GHz, or even up to 60 GHz, and Massive MIMO is a challenging option for providing a sufficient gain and steer-ability at millimeter wave frequencies, see "Preparing for GBit/s Coverage in 5G: Massive MIMO, PMC Packaging by Gap Waveguides, OTA Testing in Random LOS" by Per-Simon Kildal, 2015 Loughborough Antennas & Propagation Conference, 2 & 3 Nov. 2015.

Massive MIMO array antennas, or Large-scale Antenna Systems or Very Large MIMO arrays etc. are, contrarily to hitherto known antenna systems, based on the use of a large number of antenna elements, from a few tenths to hundreds or even thousands thereof, for being operated independently to adapt coherently to the incoming wave or waves in the environments in such a way that the signal-to-noise ratio is maximized. Massive MIMO is particularly advantageous in that data throughput and energy efficiency can be considerably increased e.g. when a large number of user stations are scheduled simultaneously, i.e. a multi-user scenario.

MIMO arrays and Massive MIMO Array antennas consist of several equal antenna elements side by side. This makes manufacture as well as and mounting extremely difficult, expensive and time consuming.

A massive MIMO array is the digital equivalent to a traditional phased array antenna. The phased array contains analogue controllable phase shifters on all elements in order to phase-steer the antenna beam to the direction needed. In MIMO technology there is an Analogue to Digital Converter (ADC) or a Digital to Analogue Converters (DAC) on each element, so that all beam-steering is done digitally, and no analogue phase shifters are needed. This makes the MIMO antenna system much more flexible and adaptive than phased-arrays, so that any beam shape and even multiple beams can be formed. This is referred to as digital beamforming.

All known antenna arrangements, even if meeting many of the functional requirements referred to above, suffer from the drawbacks of not being sufficiently easy and cheap to fabricate and not being as easy to mount as would be desired. This is a problem both for older and present generations of communication systems, and also for other implementations, but become even more pronounced for future communication systems, such as e.g. 5G, and also other future applications at higher frequencies than those used today. They also suffer from the drawback of not providing a sufficient bandwidth.

SUMMARY

It is therefore an object of the present invention to provide an antenna arrangement through which one or more of the above mentioned problems can be solved or at least alleviated.

It is particularly an object of the invention to provide a self-grounded bowtie antenna arrangement, e.g. an UWB multiport antenna for a MIMO system, which is easy and cheap to fabricate. Still further it is an object of the invention to provide an antenna arrangement which is easy to mount, and an antenna arrangement that is small and compact. Another object is to provide an antenna arrangement allowing surface mounting, and in particular surface mounting on a PCB using placement machines and soldering machines.

Even more particularly it is an object of the invention to provide an antenna arrangement, which is suitable for mass production. It is also one most particular object to provide an antenna arrangement, which is flexible and a concept that allows for fabrication of different antenna arrangements based on the same principles for many different applications.

A particular object is to provide an antenna arrangement that can be used for very high frequencies, e.g. up to 100 or even 150 GHz.

Another most particular object is to provide an antenna arrangement suitable for Massive MIMO, and even more particularly for future 5G communication systems. It is also a particular object of the invention provide an antenna arrangement that can be used in phased arrays and in MIMO arrays.

Still further it is an object to provide an antenna arrangement providing a large or even very large bandwidth.

It is also an object to provide an antenna arrangement suitable for micro base stations for wireless communication, e.g. also enabling reduction of multipath fading effects.

Another object is to provide an antenna arrangement, most particularly an UWB multiport antenna, which is suitable for use in measurement systems for wireless devices with or without MIMO capability, such as measurement systems based on reverberation chambers, or for use in OTA (Over-The-Air) test systems in anechoic chambers for wireless communication to vehicles, e.g. cars.

Still further it is an object of the present invention to provide a method for fabrication of an antenna arrangement through which one or more of the above mentioned objects can be achieved. It is in particular an object to provide a method which is easy to carry out, which involves only low costs, which is reliable and repeatable, and which allows mass-production. It is further an object of the invention to provide a method for fabrication of an antenna arrangement allowing surface mounting.

According to the present invention there is provided a self-grounded antenna arrangement, as well as antenna petals for use in such an antenna arrangement, and a method for production of such an antenna arrangement, in accordance with the appended claims.

Advantageous embodiments are given by the respective appended dependent claims.

According to a first aspect of the present invention there is provided a self-grounded antenna arrangement comprising an antenna structure comprising a number of antenna petals comprising arm sections tapering towards central end portions and comprising or being made of an electrically, conducting material, the end portions being arranged to approach a base plate working as a ground plane, the arm sections are optionally being connected to form at least partwise the walls of a horn, and an antenna feed arranged connected to or in the vicinity of said central end portions. Further, the base plate comprises a conducting ground plane or a Printed Circuit Board (PCB), and each antenna petal is made in one piece, or two or more antenna petals are combined to one piece, and comprises a metal surface, and e.g. being made from a metal sheet or similar. Still further, the, or each, antenna petal is adapted to be fabricated separately from the conducting ground plane or the Printed Circuit Board (PCB), and to be mountable onto a front or back side of the base plate by means of surface mounting technology (SMT).

In the context of the present application, a "self-grounded antenna" refers to a antenna wherein the antenna petals are connected to ground, at least at an part of the antenna petals being distant from an antenna feed associated or connected to the antenna petals. An example of such a self-grounded antenna is bow-tie antennas, discussed e.g. in WO 2014/062112, by the same applicant.

The antenna petals may all be provided as separate pieces. However, the antenna petals may also be connected to each other, by connections extending e.g. along the rim of slot feeds, thereby providing, at least partwise, the walls of a horn. Thus, two or more antenna petals may be provided as combined, monolithic units.

Antennas of this type have been found to have remarkably good performance. The antennas can be used as single antennas, or many in combinations. In particular it is preferred to use many antennas of this type arranged as an antenna array. The antennas can also easily be adapted and used for many different frequencies and frequency ranges, and are particularly suitable for high frequencies.

It has now been found that such self-grounded antennas can be produced relatively easy and cost-effectively by use of surface mounting technology (SMT). Thus, antenna petals can be produced separately, and be arranged on a base plate by using pick-and-place technology, or other surface mount technology (SMT) component placement systems. Hereby, the elements to be picked and placed, e.g. the antenna petals, may be arranged on trays or the like, and be picked up one element at a time from the supply, e.g. by means of pneumatic suction cups. The suction cups may be attached to a plotter-like device, or other arrangements, to place the picked up elements on a conductive layer that may be located on a dielectric substrate thereby forming a PCB. When placed on the conductive layer, such as a metallized substrate, the element(s) may be maintained in place by adhesive solder-paste or the like. When all elements have been placed on the substrate/layer, the assembly can be heat treated at an elevated temperature, whereby the solder-paste melts and fixes the placed elements to the substrate/layer. This solder connection is very strong after returning to room temperature.

In one line of embodiments, the central end portion of each antenna petal is connected to one or several antenna feed(s). The above-discussed WO 2014/062112 pertains to this type of embodiments. In particular, the end portions may have an end tip portion being adapted to be connected to feeding ports, a specific port being provided for each, or the, antenna petal comprising an arm section, and the, or each antenna petal may further comprise a mixed functionality of a curved monopole antenna and a loop antenna.

However, in an alternative line of embodiments, the central end portion of each antenna petal is conductively connected to the ground plane, and arranged in the vicinity of the antenna feed. Hereby, the antenna petals resembles the function of a so-called TEM horn. Preferably, each of the end portions are in conductive metal contact with one edge of an excitation opening, such as an excitation slot, in the ground plane, and wherein at least one antenna feed is arranged within or underneath the excitation opening. The end portions may further be arranged in such a way that there is one petal connected to each edge of the array of excitation openings/slots in the ground plane, whereby each opening/slot excites a wave propagating between two neighboring petals similar to the excitation of a so-called TEM horn antenna, and even in such a way that two opening/slot-excited petals comprise a wideband mixed functionality of a two curved monopole antenna excited as a dipole and two loop antennas.

The excitation opening may have different shapes. In one embodiment, the excitation openings may be formed in a rectangular, circular or oval shape. In particular, elongate rectangular and oval excitation openings are suitable for a single polarization, and quadratic or circular excitation openings are suitable for dual polarizations.

The excitation opening may also have an elongate form, and wherein the mid-portion is narrower than the end-portions, such as having a bone shape or an I- or H-shape. This provides a more uniform radiation distribution.

The the excitation opening may be formed as an etched recess in a PCB, and wherein the antenna feed is arranged on the other side of the PCB substrate.

The antenna feed may further comprise at least one microstrip, having an end protruding into the bounds of the excitation opening. For dual polarizations, two such microstrip ends may protrude into the bounds of the excitation opening, and being arranged at an angle relative to each other. An even better radiation pattern is obtained by using four such microstrip ends, wherein the microstrip ends having the same polarization are arranged opposite each other.

The metal surface of each antenna petal is preferably arranged in a curved or bent disposition, forming one or several inclined surface areas in relation to the ground plane. The curved or bent shape may comprise rounded sections and/or or relatively straight sections arranged at an angle relative to each other.

The metal surface preferably comprises at least one surface area being essentially flat, engageable by pneumatic suction cups. This facilitates assembly of the antenna petals by pick-and-place methodology, or similar SMT methodology.

Particularly, each antenna petal may comprise a first, planar, connecting portion adapted for connection to the front side of the metal ground plane or the PCB, a first wall portion forming an angle with the plane in which the first connecting portion extends, an intermediate mounting portion, which e.g. is flat or comprises a flat portion, and is arranged to interconnect said first wall portion with a second wall portion in an opposite end connecting to, or turning into the, second connecting, end tip portion disposed in the same plane as the first connecting portion. The first connection portions of each antenna petal may be soldered or otherwise fixed by screws or pop rivets onto the metal ground plane or the PCB.

In case the antenna petals are to be directly connected to the antenna feed, the end tip portion of each antenna petal may comprise a small, flat rounded portion. The end tip portion of each antenna petal may also comprise an opening adapted for reception of a conducting pin that is soldered to the end tip portion of the antenna petal.

Preferably, an end of each antenna petal being opposite to said central end portion is conductively connected to the ground plane, and preferably fixedly connected to the ground plane, e.g. by being soldered or fixed by screws or pop rivets.

The, or at least some, antenna petal or petals of the antenna structure may further comprise a slot or a slotted structure provided in the first wall portion, preferably also extending at least partially into the first connection portion, e.g. being split up into two leg portions or forming a closed slot, or extending at least partially also into the second wall portion, or comprise one or more external edge slot structures to provide for improved bandwidth matching and increased performance.

The antenna petal, or at least some antenna petals of the antenna structure may also comprise a groove formed by the first wall portion and an additional wall portion connecting to the first connection portion at a side opposite the side where the first wall portion is located and extending substantially in parallel with said first wall portion. The additional wall portion may have a length adapted to the length of the first wall portion. The additional wall portion may have a length adapted to the length of an outer side of the conducting ground plane or PCB. The antenna petal, or at least some antenna petals of the antenna structure, may also comprise one or more slots and a groove formed by the first wall portion and an additional wall portion.

In case the central end portion is to be directly connected to the antenna feed, the metal ground plane or the PCB may comprise a dielectric portion adapted to be located under the, or each, second connecting end tip portion, or that a hole is provided in the ground plane under the, or each, second connecting end tip portion, to keep the end tip portion or portions isolated from the conducting ground plane. The dielectric portion may comprise a thin dielectric film adapted to be located under one or more antenna petal second connecting end tip portions to keep them isolated from the conducting ground plane. Alternatively, the dielectric portion may comprise a thick dielectric film adapted to be located under one or more second connecting end tip portions for providing support for one or more antenna petal or petals and keep them isolated from the ground plane.

The antenna arrangement may comprise at least two antenna petals arranged to form antenna structures comprising one or more bowties, wherein the antenna ports of the antenna petals of a bowtie may be adapted to be independently excited.

The antenna arrangement may further comprise at least two antenna petals arranged to form antenna structures comprising one or more bowties, wherein the antenna ports or feeds of the antenna petals of or associated with one or each bowtie having similarly polarized ports or feeds are excited differentially. The antenna ports or feeds of the antenna petals of or associated with one or each bowtie may be connected to and combined by a respective balun, each balun e.g. being realized by a 180° hybrid located on the side of the metal ground plane or the PCB on which the antenna petals are located, forming the front side, or on the back side of the metal ground plane or the PCB, and in that similarly polarized ports or feeds are excited differentially.

The antenna arrangement may comprise an antenna structure comprising two antenna petals arranged to form a bowtie comprising two ports or feeds, wherein the ports or feeds are differentially excited, hence forming a one-port/feed antenna with linear polarization.

The antenna arrangement may further comprise an antenna structure comprising four antenna petals arranged to form a bowtie comprising four ports or feeds, and wherein the similarly polarized ports or feeds are differentially excited, hence forming a two-port/feed antenna with orthogonal linear polarizations.

The antenna arrangement may comprise an antenna structure comprising a number of antenna petals arranged to form a number, N, of bowties, each comprising four ports or feeds, said bowties being arranged in a linear array, and wherein similarly polarized ports or feeds are differentially excited, hence forming a linear array of N two-port/feed bowties antenna, adapted for use e.g. with an 2×N-port/feed Massive MIMO base station or another 2×N-port/feed application.

The antenna arrangement may also comprise an antenna structure comprising a number, e.g. 16 or 64, of antenna petals arranged to form a number, N, of bowties, each comprising four ports or feeds, said bowties being arranged in a planar array, and wherein similarly polarized ports or feeds are differentially excited, hence forming a planar array of N two-port/feed bowties antenna, adapted for use e.g. with an 2×N-port/feed Massive MIMO base station or another 2×N-port/feed application.

The antenna arrangement may comprise at least two antenna petals, forming one or more bowties, and wherein the ports or feeds for each of the antenna petals are substantially uncoupled such that their far field functions are substantially orthogonal in either polarization, direction or shape.

Alternatively, the antenna may comprise (only) one antenna petal.

The antenna arrangement may be an ultra-wideband antenna arrangement.

The antenna arrangement may be adapted for use in wireless systems with MIMO technology, e.g. in a micro base station, particularly for use in Massive MIMO base stations.

Each antenna petal end tip portion may be fed via a conductive pin or wire received in an opening provided in the respective end tip portion.

The antenna arrangement may be adapted to be arranged e.g. on a mast for a MIMO base station, or for a Massive MIMO base station and wherein it has a MIMO-algorithm-combined radiation pattern covering substantially 4π, i.e. has a spherical coverage or field of view, or that it is adapted to have a MMO-algorithm-combined radiation pattern covering substantially 2π, i.e. has a hemi-spherical coverage, or whatever coverage is specified and can be different in the horizontal and vertical planes.

According to another aspect of the present invention, there is provided an antenna petal adapted to be used to provide a self-grounded antenna arrangement and to form part of an antenna structure, and comprising an arm section tapering towards a respective central end portion and being made of an electrically conducting material or comprising a metal surface layer, the central end portion being adapted to allow connection to a feeding port. Each antenna petal is made in one piece, or optionally being connected with one or more antenna petals to form at least partwise the walls of a horn, and comprises a metal surface, and e.g. being made from a metal sheet or similar, and wherein the antenna petal is adapted to be mountable onto a front or back side of a base plate, e.g. comprising a conducting ground plane or a Printed Circuit Board (PCB), by means of surface mounting technology (SMT) and to be fabricated separately from said conducting ground plane or Printed Circuit Board (PCB) onto which it is to be mounted.

Hereby, similar specific embodiments, features, advantages and combinations as discussed in the foregoing in relation to the first aspect of the invention are obtainable and useable.

The metal surface of the antenna petal may be arranged in a curved or bent disposition, forming one or several inclined surface areas in relation to the ground plane onto which it is to be mounted.

Further, the metal surface may comprise at least one surface area being essentially flat, engageable by pneumatic suction cups.

The antenna petal may specifically comprise a first, planar, connecting portion adapted for connection to the front side of the metal ground plane or the PCB, a first wall portion forming an angle with the plane in which the first connecting portion extends, an intermediate mounting portion, which preferably is flat and is arranged to interconnect said first wall portion with a second wall portion in an opposite end connecting to, or turning into a second connecting end tip portion disposed in the same plane as the first connecting portion and also being adapted for connection to the base plate.

The antenna petal may also comprise a slot or a slotted structure provided in the first wall portion, preferably also extending at least partially into the first connection portion, e.g. being split up into two leg portions or forming a closed slot, or extending at least partially also into the second wall portion, or comprises one or more external edge slot structures and/or a groove formed by the first wall portion and an additional wall portion connecting to the first connection portion at a side opposite to the side where the first wall portion is located and extending substantially in parallel with said first wall portion wherein the additional wall portion has a length adapted to the length of the first wall portion or wherein the additional wall portion has a length adapted to the length of an outer side of the conducting ground plane or PCB.

According to yet another aspect of the present invention, there is provided a multiple self-grounded antenna arrangement comprising two or more antenna arrangements, of the type discussed above in relation to the first aspect, which are arranged adjacent one another substantially in a same plane or along a surface, and wherein they are so arranged with respect to one another that the ports or feeds e.g. are arranged on or close to outer side edges of conducting ground planes or PCBs, or on the front or back sides.

Hereby, similar specific embodiments, features, advantages and combinations as discussed in the foregoing in relation to the first aspect of the invention are obtainable and useable.

According to a further aspect of the present invention, there is provided a method for fabrication of a self-grounded antenna arrangement comprising at least one antenna petal comprising an arm section of an electric, conducting material tapering towards a central end portion. The method comprises:

fabricating the antenna petal or antenna petals by punching and pressing each antenna petal in one piece from a sheet of metal;

mounting, using a surface mounting technique, e.g. by soldering one or more antenna petals in a desired antenna petal structure, e.g. forming one or more bowties, onto a base portion comprising conducting ground plane or a PCB;

connecting, by means of conducting wires or pins, the central end portions of the one or more antenna petals with antenna feed(s), or connecting the central end portions to the conducting ground plane in the vicinity of the feed(s).

Hereby, similar specific embodiments, features, advantages and combinations as discussed in the foregoing in relation to the first aspect of the invention are obtainable and useable.

The method may further comprise:

punching and pressing each antenna petal to assume a shape, e.g. comprising a first, at least partially planar, connecting portion, adapted for connection to the front side of the metal ground plane or the PCB, a first wall portion forming an angle with the plane in which the first connecting portion extends, an intermediate mounting portion, which preferably is flat or comprises a flat portion, and is arranged to interconnect said first wall portion with a second wall portion in an opposite end connecting to, or turning into a second connecting end tip portion disposed in the same plane as the first connecting portion and also being adapted for connection to the base portion.

According to still another aspect of the present invention, there is provided a self-grounded antenna arrangement comprising an antenna structure comprising: a base plate working as a ground plane and comprising a conducting ground plane or a Printed Circuit Board (PCB);

a number of antenna petals comprising arm sections tapering towards central end portions and comprising or being made of an electrically, conducting material, the end portions of each antenna petal being conductively connected to the ground plane, wherein each antenna petal is made in one piece, or optionally being connected with one or more antenna petals to form at least partwise the walls of a horn, and comprising a metal surface, and e.g. being made from a metal sheet or similar;

at least one excitation opening, such as an excitation slot, formed in the ground plane; and at least one antenna feed arranged within or underneath the excitation opening;

wherein each of the end portions are in conductive metal contact with one edge of one of said at least one excitation opening(s).

Hereby, similar specific embodiments, features, advantages and combinations as discussed in the foregoing in relation to the first aspect of the invention are obtainable and useable.

The end portions are preferably arranged in such a way that there is one petal connected to each edge of an array of excitation openings/slots in the ground plane, whereby each opening/slot excites a wave propagating between two neighboring petals similar to the excitation of a so-called TEM horn antenna, and even in such a way that two opening/slot-excited petals comprise a wideband mixed functionality of a two curved monopole antenna excited as a dipole and two loop antennas.

The excitation opening may be formed in a rectangular, circular or oval shape. Alternatively, the excitation opening may have an elongate form, and wherein the mid-portion is narrower than the end-portions, such as having a bone shape or an I- or H-shape.

The excitation opening may be formed as an etched recess in a PCB, and wherein the antenna feed is arranged on the other side of the PCB.

The the antenna feed preferably comprises at least one microstrip, having an end protruding into the bounds of the excitation opening.

By means of the present invention, in all its above-discussed aspects, a multiport antenna is provided, which, in addition to being extremely easy and cheap to fabricate and mount, also enables a weak mutual coupling between the antenna ports, so that the far field functions become almost orthogonal. Particularly a multiport antenna arrangement with a weak mutual coupling between the antenna ports is provided which ensures that far field functions are orthogonal in some sense, such as in terms of polarization, direction or shape. With orthogonal is here meant that the inner products of the complex far field functions are low over the desired coverage of the antenna arrangement. Particularly, there is also provided an UWB antenna arrangement which, in addition to being extremely easy and cheap to fabricate and mount, also is suitable for measurement systems for wireless devices of wireless systems, with or without MIMO capability, most particularly for Massive MIMO, which has multiple ports, with a weak coupling, particularly no coupling at all, or at least a coupling which is as low as possible between them, and orthogonal far field functions.

The inventive concept is particularly advantageous for antenna arrangements for use in MIMO antenna systems for statistical multipath environments, most particularly for Massive MIMO antenna systems.

It is a an advantage of the invention that it facilitates manufacturing and assembly and enables a considerable reduction in manufacturing and assembly costs through the provisioning of elements, that can be mass-produced, with a shape that makes it possible to mount them side by side on a surface by an automatic machine. Such elements can be referred to Surface Mount Devices (SMD), if they are small enough to be mounted on a Printed Circuit Board (PCBs). The technology itself is called Surface Mount Technology (SMT), and the placement equipment used to mount SMDs on PCBs are commonly known as pick-and-place machines. The SMDs are normally fixed to the PCB by soldering in a wave soldering machine or a selective soldering machine following the pick-and-place machine. Thus, using SMT technology, can significantly reduce the manufacture cost of massive MIMO arrays, and in particular when they are used at high frequency.

An antenna arrangement containing two opposing halves is herein referred to as a bowtie, each half referred to as a petal. However, each half can also be used separately as a half-bowtie antenna element. More commonly two full bowtie antenna arrangements are mounted orthogonal to each other to form a dual-polarized bowtie arrangement as described in the references WO2014/062112 and H. Raza, A. Hussain, J. Yang and P.-S. Kildal, "Wideband Compact 4-port Dual Polarized Self-grounded Bowtie Antenna", IEEE Transactions on Antennas and Propagation, Vol. 62, No., pp. 1-7, September 2014 referred to above, said references hereby being incorporated in their entirety by reference. A dual-polarized bowtie has therefore four petals of which each opposing pair can be differentially excited to form a dual polarized two-port antenna.

The antenna arrangement according to the invention can be used both in phased arrays and in MIMO arrays.

BRIEF DESCRIPTION OF THE DRAWINGS

The invention will in the following be further described in a non-limiting manner, and with reference to the accompanying drawings, in which:

FIG. 22G is a top view of still another alternative antenna petal element comprising an internal slot and edge slots before being folded or bent, FIGS. 23A and B are a top view of a metal sheet, before bending, and a cross-sectional view of the same metal sheet in a bent state, respectively, of yet another alternative antenna petal element, FIGS. 24A, B and C show yet another alternative antenna petal element, wherein

DETAILED DESCRIPTION

Figure 1:
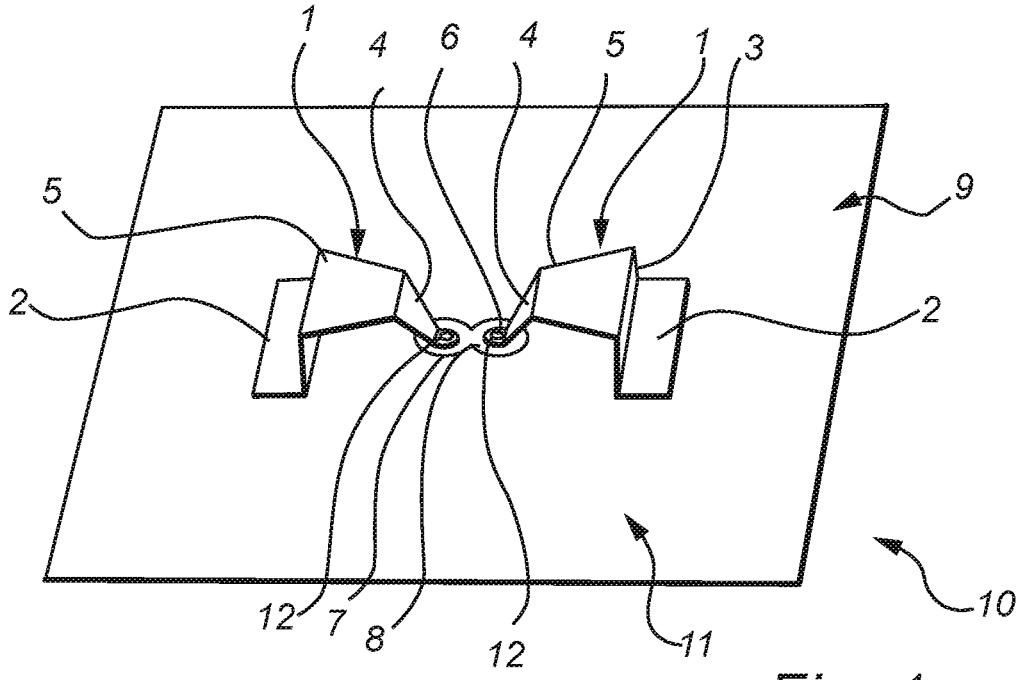
FIG. 1 is a view in perspective of an antenna arrangement according to a first embodiment of the present invention comprising two antenna petals, corresponding to a linearly-polarized bowtie antenna.

FIG. 1 shows a first embodiment of a bowtie antenna arrangement 10 according to the invention which comprises one bowtie structure 11 comprising two antenna petals 1 made of an electrically conducting material forming two arm sections which are so arranged that end or end tip portions 6 of the arm sections point substantially towards one another at a location e.g. at the center of a front, in FIG. 1 upper, side of a metal ground plane or a PCB (Printed Circuit Board) 9 for forming antenna ports. The end tip portions 6 are here provided with holes or openings 7 for soldering of conducting elements, e.g. conducting wires or pins 12 which are connected to coaxial or microstrip lines, or a circuit (not shown), located on the back (lower) side of the metal ground plane or the PCB 9.

The bowtie antenna arrangement 10 comprises two opposing halves, with are fed separately from two centrally located feed points. The two feed points can be used independently as two separate ports, but they can also be fed differentially as one port. In the latter case there may be provided a so-called balun to make a transition from the two balanced feed points to the single-ended port. The latter is then normally a single coaxial cable or a microstrip line. The balun can also be realized as a separate circuit called a 180° hybrid. The balun or 180° circuit must in such case be realized at the back side of the PCB, or at a part of the front side of the PCB where it does not interact with the performance of the bowtie antenna arrangement itself.

In one embodiment the two ports are combined by a balun e.g. realized by a 180° hybrid (not shown), as referred to above, on the back side of the metal ground plane or the PCB 9. The two ports can then be differentially excited, the antenna arrangement 10 hence forming a one-port antenna with a single linear polarization.

In an alternative embodiment (not shown), the balun may be provided on the front side of the metal ground plane or the PCB 9.

The antenna petals are preferably curved or bent, either continuously or in distinct, straight sections arranged with an angle in relation to each other. In the embodiment illustrated in FIG. 1, each antenna petal 1 comprises a first, planar, connecting portion 2 adapted for connection, e.g. by soldering, screwing or fastening by means of pop rivets, to the front or upper side of the metal ground plane or the PCB 9, a first wall portion 3 forming an angle, e.g. between 70° and 120°, particularly between 80° and 110°, but alternatively any other appropriate angle, with the plane in which the first connecting portion 2 extends, an intermediate mounting portion 5, which preferably is flat and interconnecting said first wall portion 3 with a second wall portion 4 arranged to form a second angle with the plane of extension of said first, planar, connecting portion 2. Said second angle may e.g. also be between 70° and 120°, particularly between 80° and 110°, but alternatively any other appropriate angle, and particularly smaller than the first angle, such that the second walls are disposed in a more slanting, less steep manner with respect to the plane of e.g. the ground plane or the PCB 9. The second wall portion 4, at its end opposite to where it connects to, or turns into, the intermediate mounting portion 5, connects to, or turns into a second connecting end tip portion 6 disposed in the same plane as the first connecting portion and comprising a hole or opening 7 adapted for reception of the connecting pin 12 for connection to a feeding port. The second connecting end tip portion 6 preferably comprises a small, flat rounded portion surrounding opening 7.

The metal-layer of the PCB surface 9 may comprise a hole located under the, or each, second connecting end tip portions 6, in such a way that the connecting end portions rest directly on the dielectric substrate of the PCB and thereby are isolated from the upper metal surface of the PCB. This isolation can also be achieved in other ways, e.g. by a dielectric sheet on top of the PCB.

Due to the shape of the petals 1, a bowtie antenna structure 11 is provided which allows surface mounting using SMT (Surface Mount Technology). Particularly, due to the first, planar, connecting portion 2 being flat, surface mounting is facilitated since the petals easily can be lifted. It also becomes possible to mount a number of petals 1 on a PCB or a metal ground plane using a so called placement machine, also called pick-and-place machine. Furthermore, due to the shape of the petals, the petals can easily be fabricated in a cost-effective manner through mass-production through punching from a thin metal plate, and pressing. It is also compatible with conventional PCB technology. Preferably a petal is made in one piece. Still further, the petals are attached to the conducting ground plane in any appropriate manner, e.g. by soldering.

Through the inventive concept mass production of bowtie antenna arrangements of different kinds is thus enabled, which is extremely advantageous. Particularly one or more petals can be lifted due to the first, planar, connecting portion 2, which preferably at least partly is flat, and attached to, e.g. soldered onto, a metal ground plane or a PCB, and then baked in an oven.

Picking and placing of elements such as the antenna petal can be made by a per se known pick-and-place equipment. Preferably, the waveguide elements are provided on tapes, on trays or the like, and are picked by a pick-up arrangement, e.g. using pneumatic suction cups. The waveguide elements are then placed on the substrate. The substrate preferably has an adherent surface, to maintain the placed waveguide elements in place during assembly. When all waveguide elements have been properly placed, the connection between the waveguide elements and the substrate is fixated. For example, a soldering paste could be arranged on the substrate prior to placement, which is adherent to maintain the placed elements in the right position during assembly, and which fixates the element when the substrate is subsequently heat treated at an elevated temperature, e.g. by applying infrared heating to the substrate, or by treatment in an oven.

Different numbers of petals can be arranged on a PCB in different manners, and provide antenna arrangements, e.g. with different numbers of ports, e.g. a number of differentially excited ports or a number of independently excited ports etc., or being adapted to be differently or independently excited, in some embodiments by means of slot excitation, as will be further exemplified below.

The bowtie antenna arrangement occupies typically an area of the surface that is larger than typically half wavelength at the lowest frequency of operation. Therefore, the PCB mounting is most suitable when the wavelength is smaller than and preferably much smaller than the width of the PCB, i.e. at high frequencies. Still, the same surface mountable antenna arrangement can also be used at lower frequency at which it can readily be mounted by other means to the surface and fixed e.g. by using pop rivets. Pop rivets are must faster to use than normal screws.

The surface at which the antenna arrangement is mounted works as a ground plane for the antenna.

Thus, it becomes possible to easily fabricate different antenna arrangements having different numbers of ports, ports excited in different desired manners, having different characteristics and being suitable for different applications, e.g. as elements in a Massive MIMO array for 5G communications systems, but of course also for other implementations.

A bowtie antenna arrangement according to the present invention has a large bandwidth, e.g. up to octave bandwidth or even more.

In particular embodiments the PCB comprises a circuit board with micro-strip lines (not shown). Ports e.g. comprising coaxial connectors can be attached to the back side, the front side or to the side edges of the PCB 9 in any desired manner. The bowtie antenna arrangements can also be mounted together with integrated circuits on the same PCB, thereby providing a complete transmitting/receiving device with a massive MIMO array for use in e.g. base stations for 5G.

The bowtie antenna element has a maximum size that is typically about half the wavelength at the lowest frequency of operation. Therefore, the antenna size is typically 10 cm when the lowest frequency is 1.5 GHz, 1 cm when it is 15 GHz, 0.5 cm at 30 GHz, and 0.25 cm at 60 GHz.

In the shown embodiment the second connecting end tip portions 6 are directed towards one another, separated only a slight distance from each other providing a very weak coupling between the ports which is extremely advantageous for MIMO systems.

Hence, although the antenna elements and the central portion are located very close to one another, a very low correlation between the ports is obtained, in particular embodiments even below 0.1 over the range 0.4-16 GHz, which is an extremely good performance. Particularly due to the fact that the arrangement is mainly made by a metal piece, the ohmic losses will be very low.

Figure 1A:
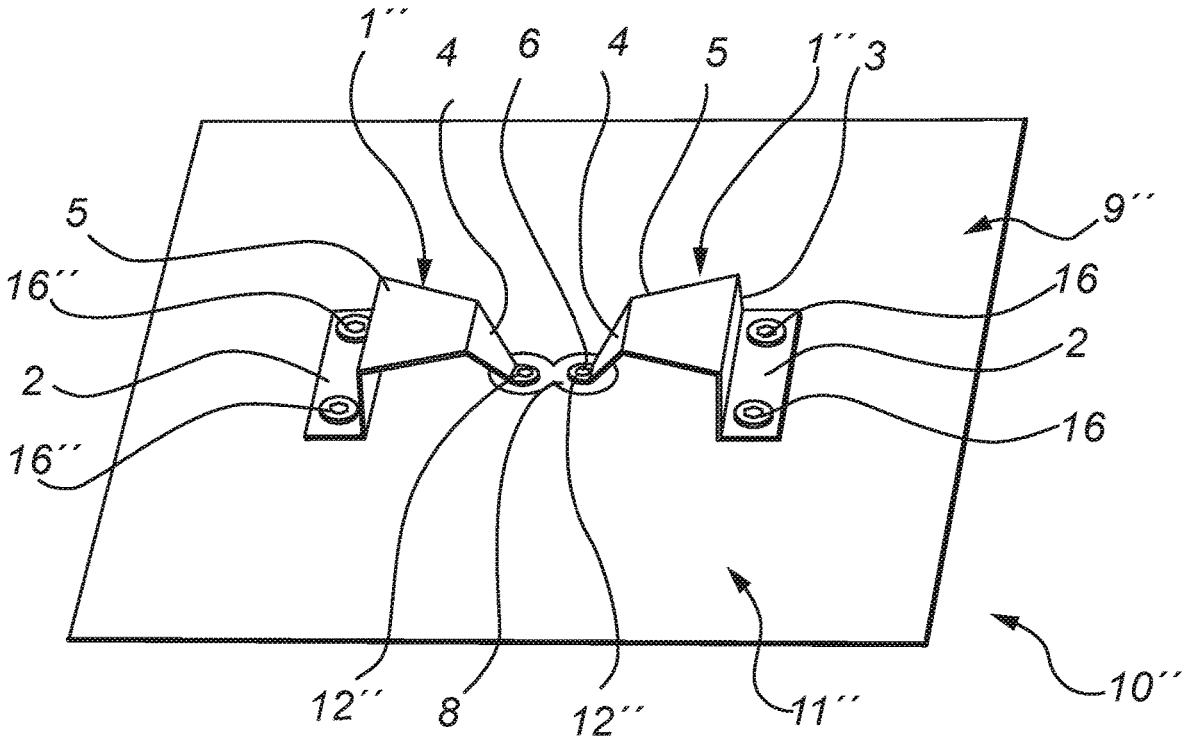
FIG. 1A is a view in perspective of an antenna arrangement of an alternative to the embodiment of FIG. 1, also comprising two antenna petals, corresponding to a linearly-polarized bowtie antenna.

FIG. 1A shows an embodiment similar to the embodiment in FIG. 1 but wherein screws, pop rivets 16" or similar are used for connecting the antenna petals 1" to the ground plane or PCB 9", which is particularly advantageous for lower frequencies, but also in other implementations. Still, however, for the central conducting pins 12", soldering should be implemented. In other respects, the functioning is similar to that described with reference to FIG. 1, and the same reference numerals are used for the shown elements, which therefore will not be further described herein.

Figure 2:
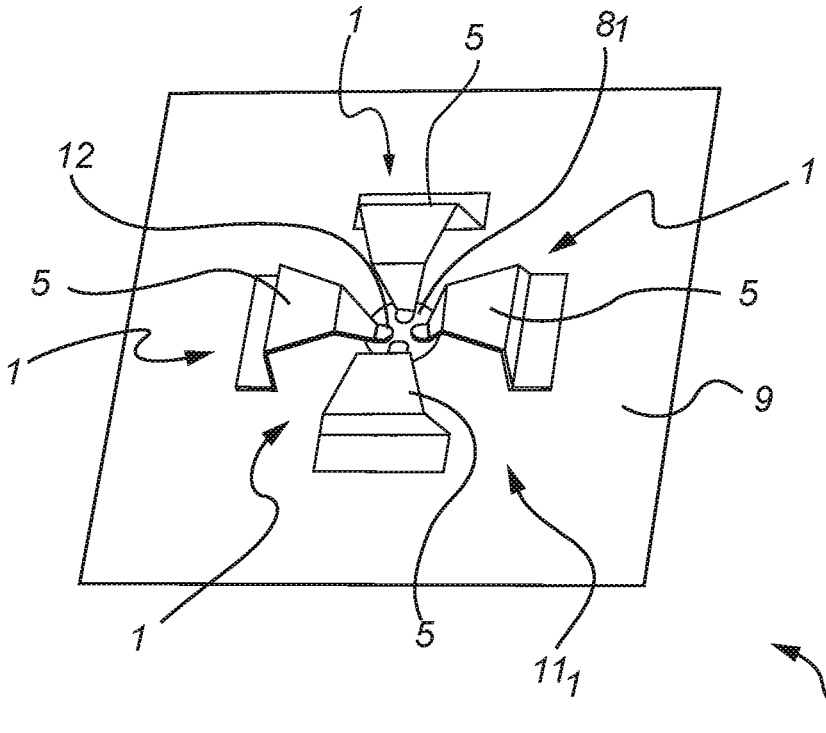
FIG. 2 is a view in perspective of an antenna arrangement with four antenna petals according to a second embodiment, corresponding to a dual-polarized bowtie antenna.

FIG. 2 shows a second embodiment of a bowtie antenna arrangement 20 according to the invention which comprises a bowtie structure $\mathbf{11}_1$ comprising four antenna petals 1, each of which being made of an electrically conducting material forming an arm as described with reference to FIG. 1. Similar elements bear the same reference numerals as in FIG. 1 and will therefore not be further described here. The end tip portions 6 provided with holes or openings for conducting wires or pins 12, 12 may, as described with reference to FIG. 1, via said conducting pins 12, 12 be connected to microstrip lines and circuits located on the back side of the central portion of the metal ground plane or the PCB 9. A thin dielectric portion $\mathbf{8}_1$ may e.g. be located under the second connecting end tip portions 6. In particular embodiments the four ports are independently excited. In other embodiments the four ports are combined by two baluns, e.g. realized by two 180° hybrids (not shown) disposed on the back side of the metal ground plane or PCB 9. The two horizontally polarized ports can then be differentially excited, as well as the two vertically polarized ports, hence providing a two-port antenna with one port for horizontal polarization and one port for vertical polarization.

In still alternative embodiments (not shown), the baluns may be provided on the front or upper side of the metal ground plane or the PCB 9.

Figure 3:
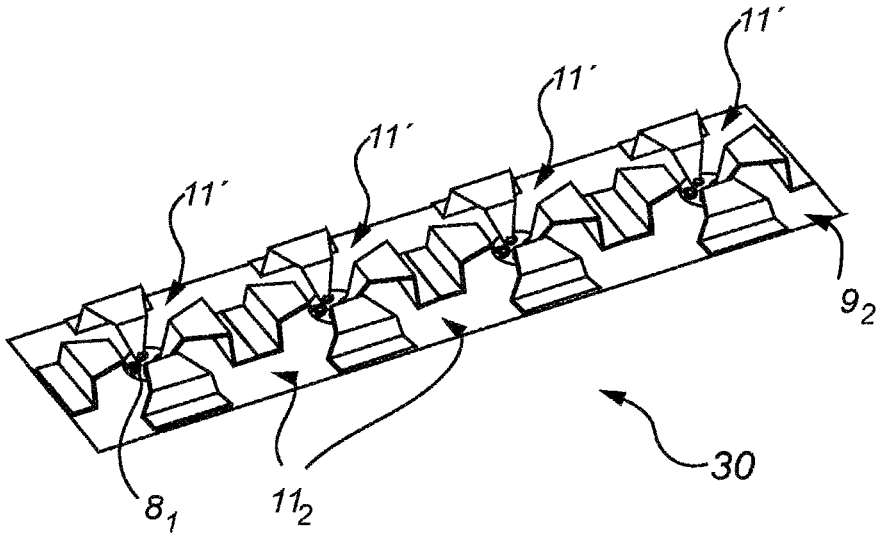
FIG. 3 is a view in perspective of a third embodiment of an antenna arrangement comprising a linear array of four dual-polarized bowtie antenna elements.

FIG. 3 shows a third embodiment of a bowtie antenna arrangement 30 according to the invention which comprises a bowtie structure $\mathbf{11}_2$ comprising four bowtie structures $\mathbf{11}_1$ as disclosed in FIG. 2 arranged in a linear array on a metal ground plane or a PCB $\mathbf{9}_2$. Similar elements bearing the same reference numerals as in FIGS. 1 and 2, have already been discussed with reference to FIGS. 1 and 2 will therefore not be further described here.

In particular embodiments the sixteen ports are independently excited.

In other embodiments the 16 ports are combined by 8 baluns, e.g. realized by 180° hybrids (not shown) disposed on the back side of the metal ground plane or PCB $\mathbf{9}_2$ as discussed above. The horizontally polarized ports can then be differentially excited, as well as the vertically polarized ports, hence providing four two-port bowtie antennas with four ports for horizontal polarization and four ports for vertical polarization. Such an implementation may e.g. be used for an 8-port Massive MIMO base station. It should however be clear that it with advantage also can be used for other applications.

In still alternative embodiments (not shown), the baluns may be provided on the front or upper side of the metal ground plane or the PCB $\mathbf{9}_2$.

Figure 4:
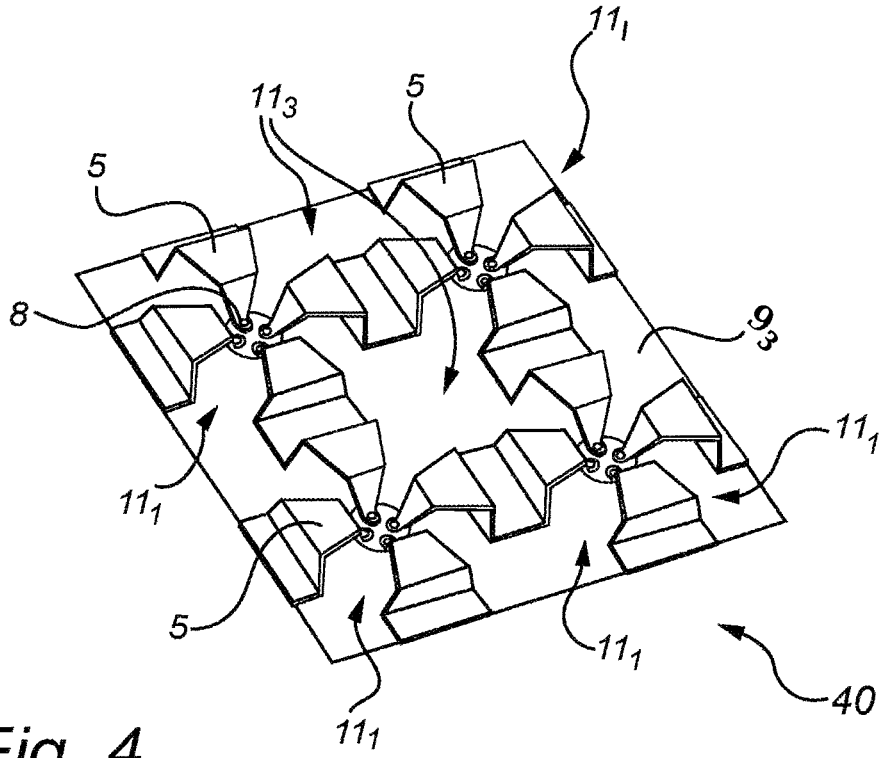
FIG. 4 is a view in perspective of a fourth embodiment of an antenna arrangement comprising a 2×2 planar array of four dual-polarized bowtie antenna elements, i.e. four dual-polarized bowties.

FIG. 4 shows a fourth embodiment of a bowtie antenna arrangement 40 according to the invention which comprises a bowtie structure $\mathbf{11}_3$ comprising four bowtie structures with each for antenna elements or petals $\mathbf{11}_1$ as disclosed in FIG. 2 arranged in a 2×2 planar array on a metal ground plane or a PCB $\mathbf{9}_3$. Similar elements bear the same reference numerals as in FIGS. 1 and 2, and since they have already been discussed with respect to these Figures, they will not be further described here. In particular embodiments the 16 ports are independently excited, whereas in other embodiments the 16 ports are combined by 8 baluns, e.g. realized by 180° hybrids (not shown) disposed on the back side, or alternatively on the front side, of the metal ground plane or PCB $\mathbf{9}_3$ as discussed above. The horizontally polarized ports can then be differentially excited, as well as the vertically polarized ports, hence providing four two-port bowtie antennas with four ports for horizontal polarization and four ports for vertical polarization. Such an implementation may also e.g. be used for an 8-port Massive MIMO base station. It should however be clear that it with advantage also can be used for other applications.

Figure 5:
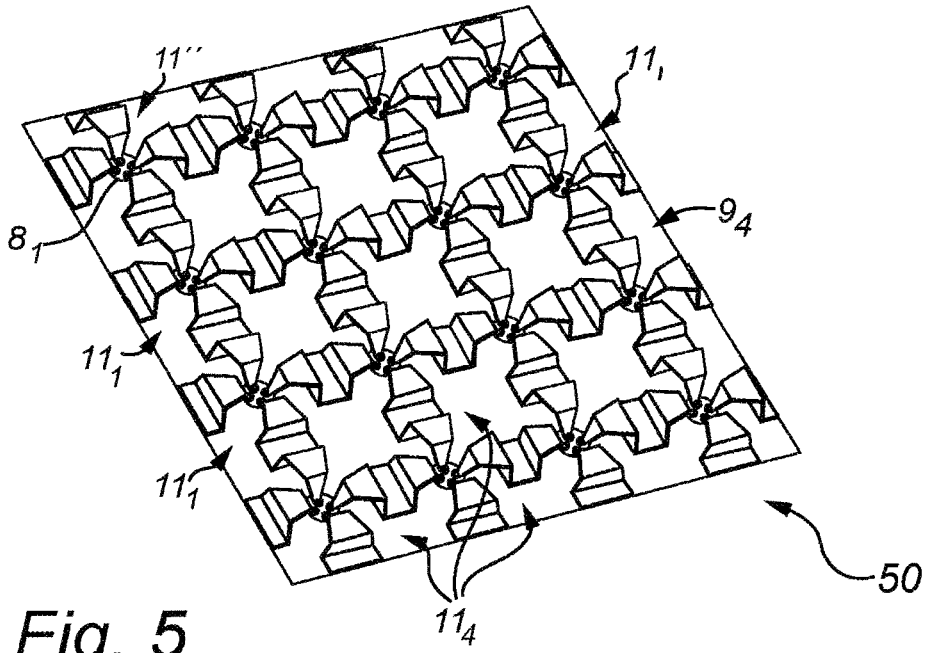
FIG. 5 is a view of a fifth embodiment of an antenna arrangement comprising a 4×4 planar array of 16 dual-polarized bowties.

FIG. 5 shows a fifth embodiment of a bowtie antenna arrangement 50 according to the invention which comprises a bowtie structure $\mathbf{11}_4$ comprising sixteen bowtie structures $\mathbf{11}_1$ with each four antenna elements or petals as disclosed in FIG. 2, arranged in a 4×4 planar array on a metal ground plane or a PCB $\mathbf{9}_4$. Similar elements bear the same reference numerals as in FIGS. 1 and 2, and will therefore not be further described here. In particular embodiments the 64 ports are independently excited, whereas in other embodiments the 64 ports are combined by 32 baluns, e.g. realized by 180° hybrids (not shown) disposed on the back side, or alternatively on the front side, of the metal ground plane or PCB $\mathbf{9}_4$ as discussed above. The horizontally polarized ports can then be differentially excited, as well as the vertically polarized ports, hence providing a 32 two-port bowtie antennas with 16 ports for horizontal polarization and 16 ports for vertical polarization. Such an implementation may also e.g. be used for a 32-port Massive MIMO base station. It should however be clear that it with advantage also can be used for other applications.

Figure 6A:
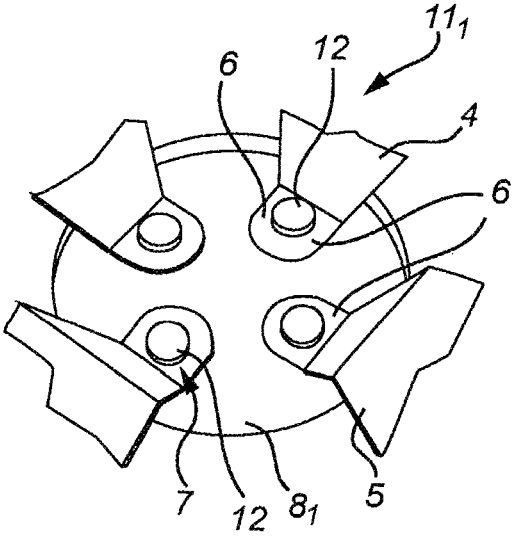
FIG. 6A is a schematic view in perspective illustrating mounting of the central portion of a dual-polarized bowtie antenna structure mounted in a PCB according to one embodiment for high frequencies.

FIG. 6A is a schematic view of the central portion of a bowtie structure $\mathbf{11}_1$, disposed on a thin dielectric film on the central portion of a PCB, showing more in detail parts of the second wall portions 4, first ends of which are connecting to, or turning into, the respective intermediate mounting portions 5 (not shown; see e.g. FIG. 1), and second, opposite ends of which are connecting, or turning, into the second connecting end tip portions 6. Each second connecting end tip portion 6 comprises a respective hole 7 adapted for soldering the conducting pins 12 as discussed above. The small, flat rounded portions of the second connecting end tip portions 6 are here located in a hole or an opening, e.g. etched out, $\mathbf{8}_1$ in the metal surface of the PCB, thereby resting directly on its substrate so that the end tip portions are isolated from the ground plane itself. Alternatively, a thin dielectric film portion $\mathbf{8}_1$ disposed on e.g. the central portion of the PCB (not shown in FIG. 6A) can be used for separating and isolating the connecting end tips from the conducting ground plane. Such implementations are particularly advantageous for high frequencies and small bowties.

Figure 6B:
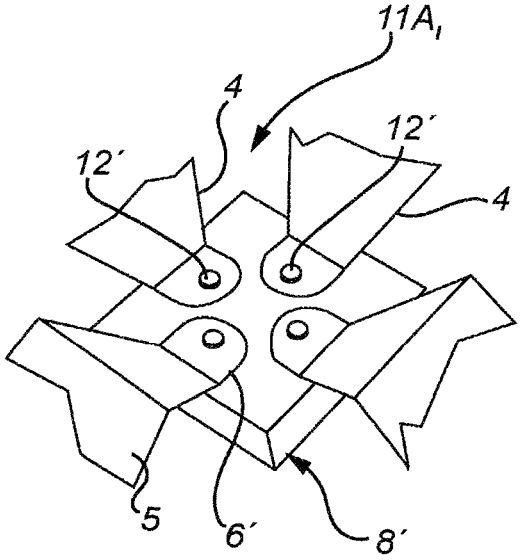
FIG. 6B is a schematic view in perspective of an alternative central portion mounting of a larger bowtie antenna for lower frequencies.

FIG. 6B is a schematic view of the central portion of a bowtie structure $\mathbf{11}\mathrm{A}_1$ disposed on a thick dielectric plug 8', e.g. comprising Teflon™, provided in e.g. the central portion of a PCB showing parts of the second wall portions 4, first ends of which connect to, or turn into, the respective intermediate mounting portions 5 (not shown; see e.g. FIG. 1), and second, opposite ends of which connecting or turning into the second connecting end tip portions 6'. Each second connecting end tip portions 6' comprises a respective hole 7' adapted for reception of the connecting pin 12' as discussed above. Thus, the small, flat rounded portions of the second connecting end tip portions 6' are disposed on a dielectric plug 8' which serves the purpose of providing an additional or enhanced mechanical support for the bowtie structure $\mathbf{11}\mathrm{A}_1$ at the same time as it provides for isolation towards the ground plane. Such implementations are advantageous for lower frequencies since for lower frequencies generally larger and heavier bowtie structures are required.

In FIGS. 7A-7D some embodiments of antenna petals are illustrated, wherein the antenna petals are shown in a folded, bent shape. In FIGS. 22A-22G below a number of antenna petals, also called antenna petal elements, are illustrated in an unfolded state, i.e. before being shaped for mounting. Punching or similar, and folding or bending into the final shape may be done in different steps or in one and the same step.

Figure 7A:
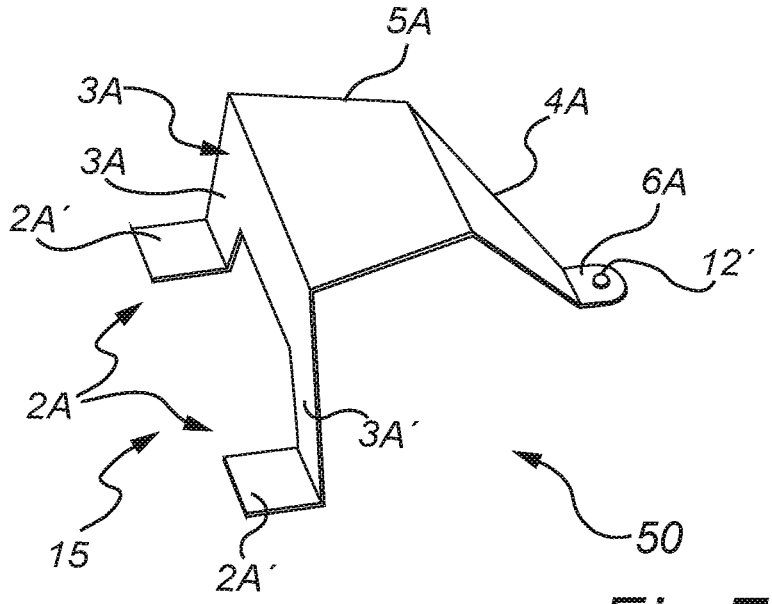
FIG. 7A is a schematic view in perspective of a petal of an alternative antenna element, provided with a slot for alternative antenna arrangements.

FIG. 7A thus shows an embodiment of a bowtie antenna petal 1A made of an electrically conducting material forming an arm section. The petal 1A comprises a first, planar, connecting portion 2A adapted for connection to a front or upper side of a metal ground plane or a PCB similar to the petal 1 of e.g. FIG. 1. The petal 1A comprises a first wall portion 3A, a second wall portion 4A forming an angle with the plane in which the first connecting portion 2A extends, an intermediate mounting portion 5A, which preferably is flat, interconnecting said first wall portion 3A with the second wall portion 4A which is arranged to form a second angle with the extension of said first, planar, connecting portion 2A. The first, planar, connecting portion 2A comprises two leg sections 2A' separated by a slot 15, and also a lower portion of the first wall portion 3A comprises two leg sections 3A' separated by the slot 15, wherein the respective leg sections of the first wall portion 3A and of the first, planar, connecting portion 2A are co-located and of the same width in the zone where the first, planar, connecting portion 2A turns into the first wall portion 3A. In other respects the petal 1A is similar to the petal 1 described with reference to FIG. 1, and the second wall portion 4A, at its end opposite to where it connects to, or turns into, the intermediate mounting portion 5A, connects to, or turns into the second connecting end tip portion 6A disposed in the same plane as the first connecting portion and comprises a hole 7A adapted for soldering a conducting wire or pin going through a hole in the ground plane for connecting the petal to a circuit below the ground plane. Also in this embodiment the second connecting end tip portion 6A preferably comprises a small, flat rounded portion surrounding opening 7A.

The purpose of the slot 15 is to improve the performance by enhancing bandwidth by reducing $|S_{11}|$, the embedded input reflection coefficient, $S_{11}$, which is a measure of the reflection at the port. Alternative embodiments of antenna elements with slots are shown in FIGS. 22C-22G below.

Figure 7B:
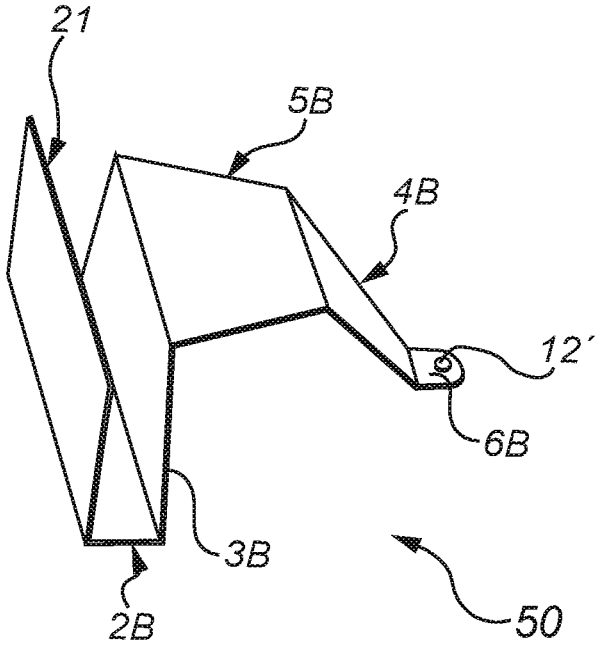
FIG. 7B is a schematic view in perspective of a petal of an alternative antenna element, provided with a corrugation for other alternative antenna arrangements.

FIG. 7B shows an alternative embodiment of an antenna petal 1B made of an electrically conducting material forming an arm section. The petal 1B comprises a first, planar, connecting portion 2B adapted for connection to a top or upper side of a metal ground plane or a PCB as the petal 1 of e.g. FIG. 1. The petal 1B further comprises a first wall portion 3B forming an angle with the plane in which the first connecting portion 2B extends, an intermediate mounting portion 5B, which preferably is flat, interconnecting said first wall portion 3B with a second wall portion 4B arranged to form a second angle with the extension of said first, planar, connecting portion 2B. The first, planar, connecting portion 2B connects, or turns into a wall portion 21 which extends substantially in parallel to the first wall portion 3B and is of substantially the same height, or somewhat higher, or even lower. Hence a groove is formed by said wall portion 21 and said first wall portion 3B. In other respects the petal 1B is similar to the petal 1 described with reference to FIG. 1, and the second wall portion 4B, at its end opposite to where it connects to, or turns into, the intermediate mounting portion 5A, connects to, or turns into, the second connecting end tip portion 6A disposed in the same plane as the first connecting portion and comprising a hole 7B adapted for soldering a wire or pin connecting to circuits on the back side of the ground plane. Also in this embodiment the second connecting, end tip, portion 6B preferably comprises a small, flat rounded portion surrounding opening 7B.

The purpose of the wall 21 is to improve performance by reducing $|S_{11}|$, reducing mutual coupling between antenna ports, and improve the radiation pattern, and to provide a constant gain and beam width over the desired frequency band.

Figure 7C:
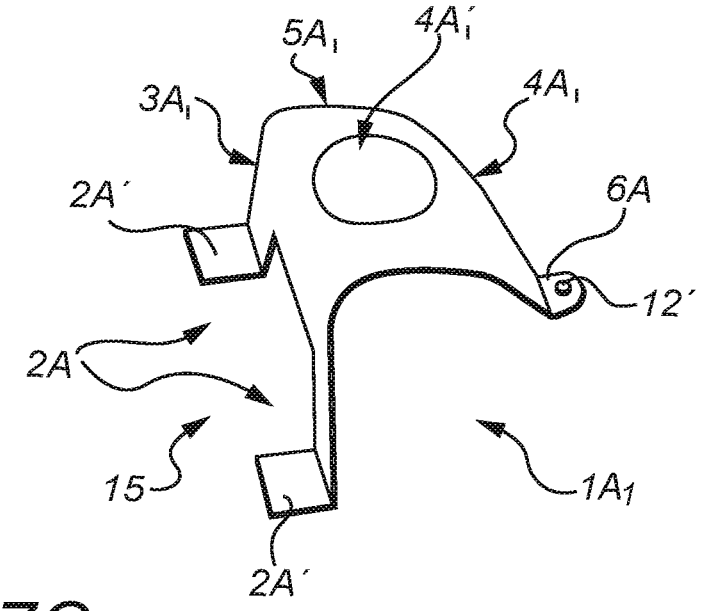
FIG. 7C is a schematic view in perspective of a petal of an alternative antenna element, with a curved petal profile with a circular flat mounting portion on the top for alternative antenna arrangements.

FIG. 7C shows another alternative embodiment of an antenna petal $\mathbf{1}A_1$ made of an electrically conducting material forming an arm section. The petal $\mathbf{1}A_1$ comprises a first, planar, connecting portion 2A comprising two leg sections 2A',2A' adapted for connection to a front or upper side of a metal ground plane or a PCB similar to the petal 1A of FIG. 7A. The petal $\mathbf{1}A_1$ hence also comprises a first wall portion $\mathbf{3}A_1$, a second wall portion $\mathbf{4}A_1$ forming an angle with the plane in which the first connecting portion 2A extends and an intermediate mounting portion $\mathbf{5}A_1$. The intermediate mounting portion $\mathbf{5}A_1$ here comprises a slightly curved or rounded portion with a circular flat mounting portion $\mathbf{5}A_1'$ e.g. at the top, and interconnects said first wall portion $\mathbf{3}A_1$ with the second wall portion $\mathbf{4}A_1$ which is arranged to form a second angle with the extension of said first, planar, connecting portion leg sections 2A'. The first, planar, connecting portion leg sections 2A' are separated by a slot 15, and also a lower portion of the first wall portion $\mathbf{3}A_1$ as also described with reference to FIG. 7A, comprises two leg sections separated by the slot 15, wherein the respective leg sections of the first wall portion $\mathbf{3}A_1$ and of the first, planar, connecting portion $\mathbf{2}A_1$ are co-located and of the same width in the zone where the first, planar, connecting portion turns into the first wall portion $\mathbf{3}A_1$. In this as well as other aspects the embodiment shown in 7C are similar to those described with reference to FIG. 7A, and will therefore no be further described here. It should be clear that an antenna petal $\mathbf{1}A_1$ comprising a top flat portion e.g. circular or of any other appropriate shape, and a curved or rounded intermediate section $\mathbf{5}A_1$ as described above in still other embodiments can be combined with a wall section and a groove e.g. as in FIG. 7B, or with an extended wall section as in FIG. 18 below, be without any slot e.g. as in FIG. 1, FIG. 22A, FIG. 22B, with other slots, e.g. as in FIGS. 22C-22G, and/or be adapted for attachment to the ground plane or PCB by means of screws or pop rivets as in FIG. 1. Many variations are possible.

Figure 7D:
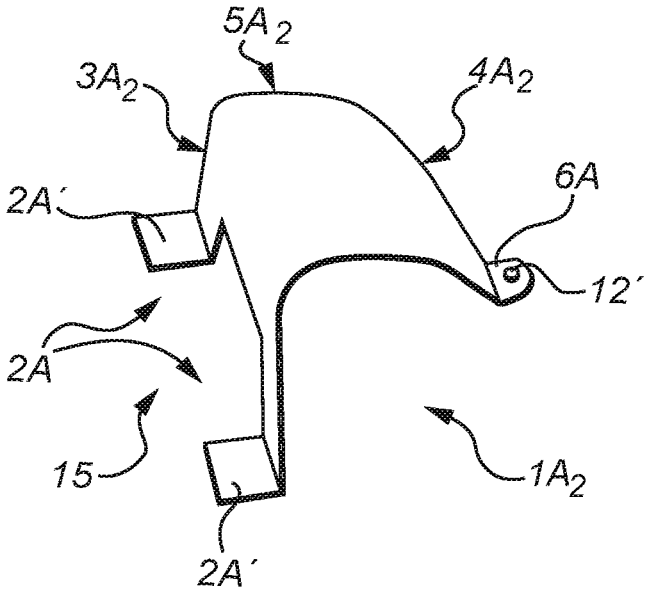
FIG. 7D is a schematic view in perspective of a petal of an alternative antenna element, with a curved petal profile without a flat mounting portion on the top for alternative antenna arrangements.

FIG. 7D shows still another alternative embodiment of an antenna petal $\mathbf{1}A_2$ made of an electrically conducting material forming an arm section. The petal $\mathbf{1}A_2$ comprises a first, planar, connecting portion 2A comprising two leg sections 2A' adapted for connection to a front or upper side of a metal ground plane or a PCB similar to the petal 1A of FIG. 7A. The petal $\mathbf{1}A_2$ also comprises a first wall portion $\mathbf{3}A_2$, a second wall portion $\mathbf{4}A_2$ forming an angle with the plane in which the first connecting portion 2A extends and an intermediate mounting portion $\mathbf{5}A_2$. The intermediate mounting portion $\mathbf{5}A_2$ here comprises a curved petal profile, without any flat mounting section, and interconnects said first wall portion $\mathbf{3}A_2$ with the second wall portion $\mathbf{4}A_2$ which is arranged to form a second angle with the extension of said first, planar, connecting portion leg sections 2A'. The first, planar, connecting portion leg sections 2A' are also in this embodiment separated by a slot 15, as a lower portion of the first wall portion $\mathbf{3}A_1$ which, as also described with reference to FIG. 7A, comprises two leg sections separated by the slot 15, wherein the respective leg sections of the first wall portion $\mathbf{3}A_2$ and the first, planar, connecting portion $\mathbf{2}A_2$ are co-located and of the same width in the zone where the first, planar, connecting portion turns into the first wall portion $\mathbf{3}A_2$. In this as well as other aspects the embodiment shown in 7D are similar to those described with reference to FIG. 7A, and will therefore no be further described here. It should be clear that an antenna petal $\mathbf{1}A_2$ comprising a curved or rounded intermediate section $\mathbf{5}A_2$ as shown in FIG. 7D in still other embodiments can be combined with a wall section and a groove e.g. as in FIG. 7B, or with an extended wall section as in FIG. 18 below, be without any slot e.g. as in FIG. 1, FIG. 22A, FIG. 22B, with other slots, e.g. as in FIGS. 22C-22G, and/or be adapted for attachment to the ground plane or PCB by means of screws or pop rivets as in FIG. 1. Many variations are possible.

Figure 8:
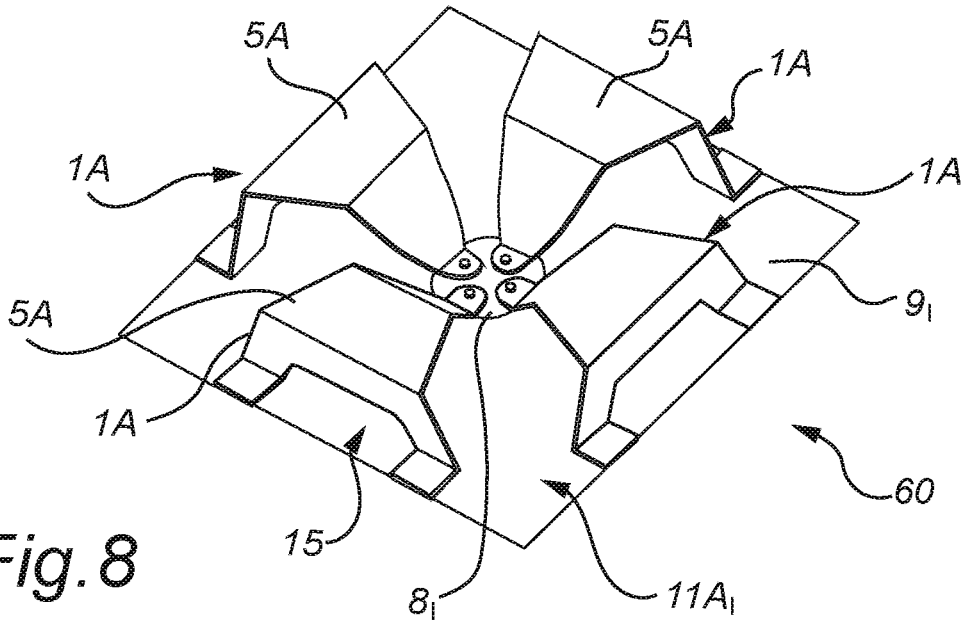
FIG. 8 is a view in perspective of a dual-polarized bowtie antenna element comprising petals with slots as in FIG. 7A according to a sixth embodiment of the invention.

FIG. 8 shows an embodiment of an antenna arrangement 60 similar to the embodiment in FIG. 2, but with the difference that the bowtie antenna elements comprise petals 1A as in FIG. 7A. Thus, the bowtie antenna arrangement 60 comprises a bowtie structure $\mathbf{11}A_1$ comprising four antenna petals 1A, each of which being made of an electrically conducting material forming an arm section as described with reference to FIG. 1. Similar elements bear the same reference numerals as in FIG. 7A and in FIG. 1, but are referenced "A", and will therefore not be further described here.

The end tip portions 6A provided with holes or openings for soldering wires or pins 12 may, as also described with reference to FIG. 1, connect to coaxial or microstrip lines or circuits located on the back (or front) side of the metal ground plane or the PCB 9A. In particular embodiments the four ports are independently excited. In other embodiments the four ports are combined by two baluns, e.g. realized by two 180° hybrids (not shown) disposed on the back (or front) side of the metal ground plane or PCB 9A. The two horizontally polarized ports can then be differentially excited, as well as the two vertically polarized ports, hence providing a two-port antenna with one port for horizontal polarization and one port for vertical polarization.

Figure 9:
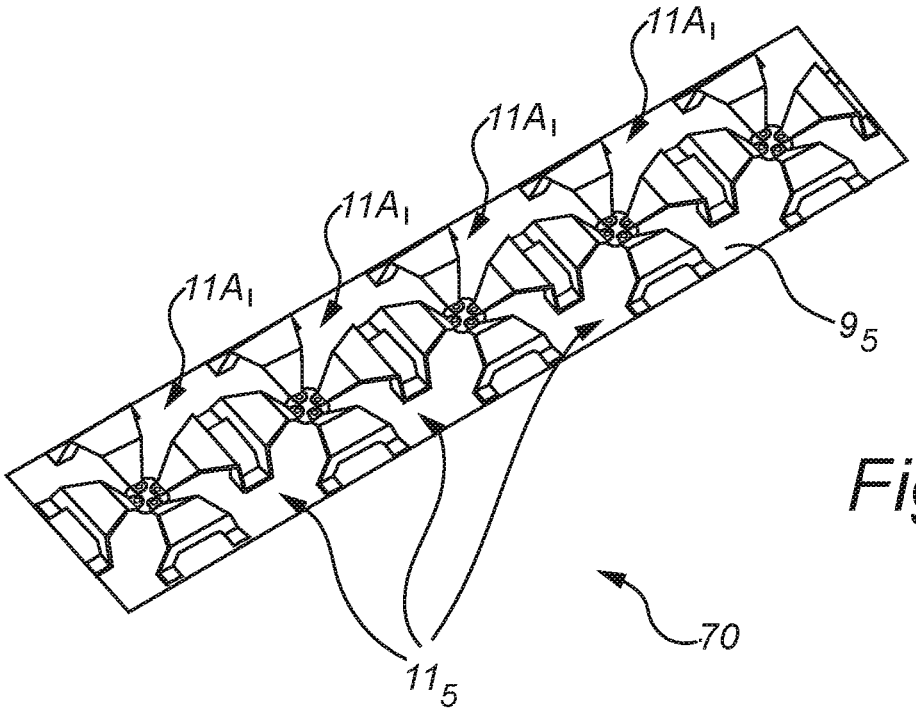
FIG. 9 is a view in perspective of a dual-polarized bowtie antenna element comprising petals with slots as in FIG. 7A, arranged in a linear array according to a seventh embodiment of the invention.

FIG. 9 shows an embodiment of a bowtie antenna arrangement 70 according to the invention which comprises a bowtie structure $\mathbf{11}_5$ comprising five bowtie structures $\mathbf{11}_{A1}$, each comprising four antenna petals 1A, as disclosed in FIG. 8 arranged in a linear array on a metal ground plane or a PCB $\mathbf{9}_5$. Similar elements bear the same reference numerals as in FIG. 8 and will therefore not be further described here. In particular embodiments the sixteen ports are independently excited. In other embodiments the 20 ports are combined by 10 baluns, e.g. realized by 180° hybrids (not shown) disposed on the back (or front) side of the metal ground plane or PCB $\mathbf{9}_5$ as discussed above. The horizontally polarized ports can then be differentially excited, as well as the vertically polarized ports, hence providing four two-port bowtie antennas with four ports for horizontal polarization and four ports for vertical polarization. Such an implementation may e.g. with advantage be used for an 8-port Massive MIMO base station. It should however be clear that it with advantage also can be used for other applications.

Figure 10:
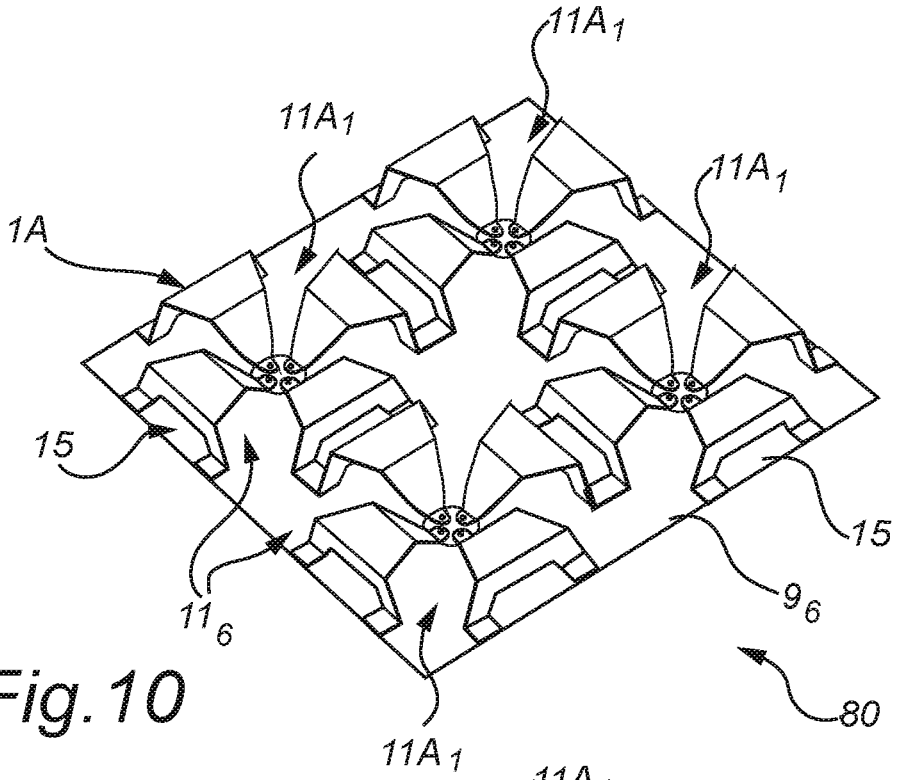
FIG. 10 is a view in perspective of dual-polarized bowtie antenna element comprising petals with slots as in FIG. 7A, arranged in a 2×2 planar array as in FIG. 4, according to an eighth embodiment of the invention.

FIG. 10 shows an of a bowtie antenna arrangement 80 which comprises a bowtie structure $\mathbf{11}_6$ comprising four bowtie structures $\mathbf{11}_{\Delta 1}$, each comprising four antenna petals 1A, as disclosed in FIG. 7A arranged in a 2×2 planar array on a metal ground plane or a PCB $\mathbf{9}_6$. Similar elements bear the same reference numerals as in FIG. 8, and will therefore not be further described here. In particular embodiments the sixteen ports are independently excited, alternatively, in other embodiments, the 16 ports are combined by 8 baluns, e.g. realized by 180° hybrids (not shown) disposed on the back (or top) side of the metal ground plane or PCB $\mathbf{9}_6$ as discussed above. The horizontally polarized ports can then be differentially excited, as well as the vertically polarized ports, hence providing four two-port bowtie antennas with four ports for horizontal polarization and four ports for vertical polarization. Such a bowtie antenna arrangement 80 may also e.g. be used for an 8-port Massive MIMO base station. It should however be clear that it with advantage also can be used for other applications.

Figure 11:
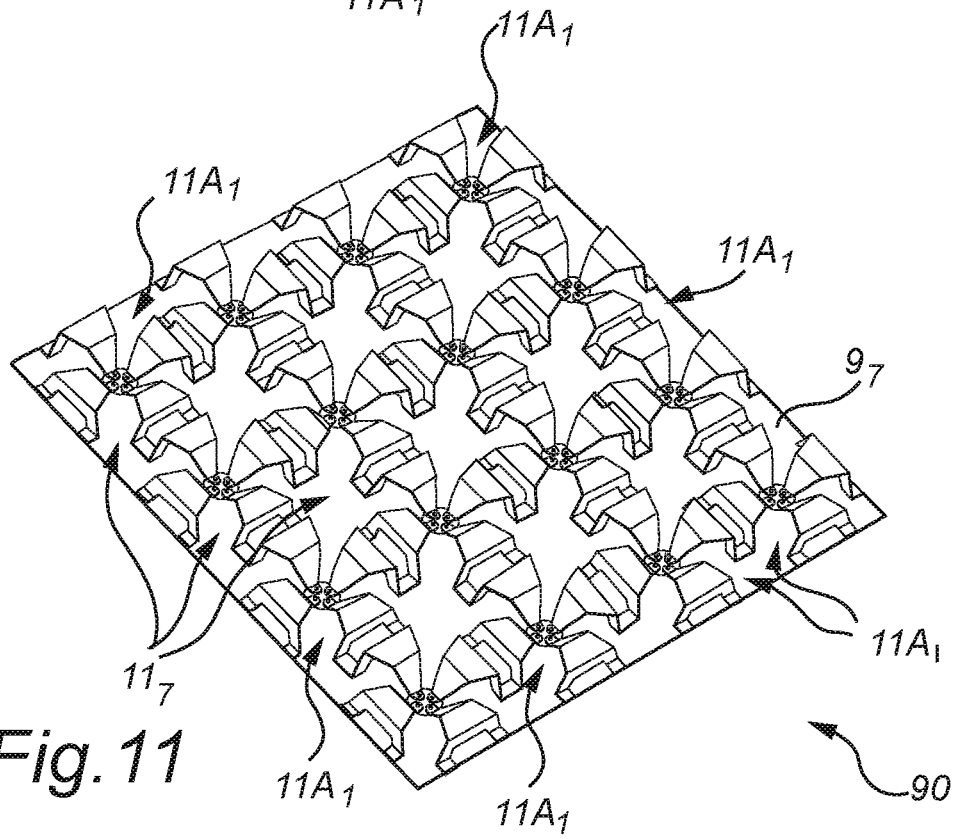
FIG. 11 is a view in perspective of a dual-polarized bowtie antenna element comprising petals with slots as in FIG. 7A arranged in 4×4 planar array as in FIG. 5, according to a ninth embodiment of the invention.

FIG. 11 shows an embodiment of a bowtie antenna arrangement 90 which comprises a bowtie structure $\mathbf{11}_7$ comprising sixteen bowtie structures $\mathbf{11}A_1$, each comprising four petals 1A, as disclosed in FIG. 8 and which are arranged in a 4—4 planar array on a metal ground plane or a PCB $\mathbf{9}_7$. Similar elements bear the same reference numerals as in FIG. 8 and will therefore not be further described here. In some embodiments the 64 ports may independently excited, or alternatively, in other embodiments, the 64 ports are combined by 32 baluns, e.g. realized by 180° hybrids (not shown) disposed on the back (or front) side of the metal ground plane or PCB $\mathbf{9}_7$ as also discussed earlier in the present application. The horizontally polarized ports can then be differentially excited, as well as the vertically polarized ports, hence providing a 32 two-port bowtie antennas with 16 ports for horizontal polarization and 16 ports for vertical polarization.

An implementation with 32 two-port bowtie antennas with 16 ports for horizontal polarization and 16 ports for vertical polarization may e.g. be used for a 32-port Massive MIMO base station. It should however be clear that it with advantage also can be used for other applications.

Figure 12:
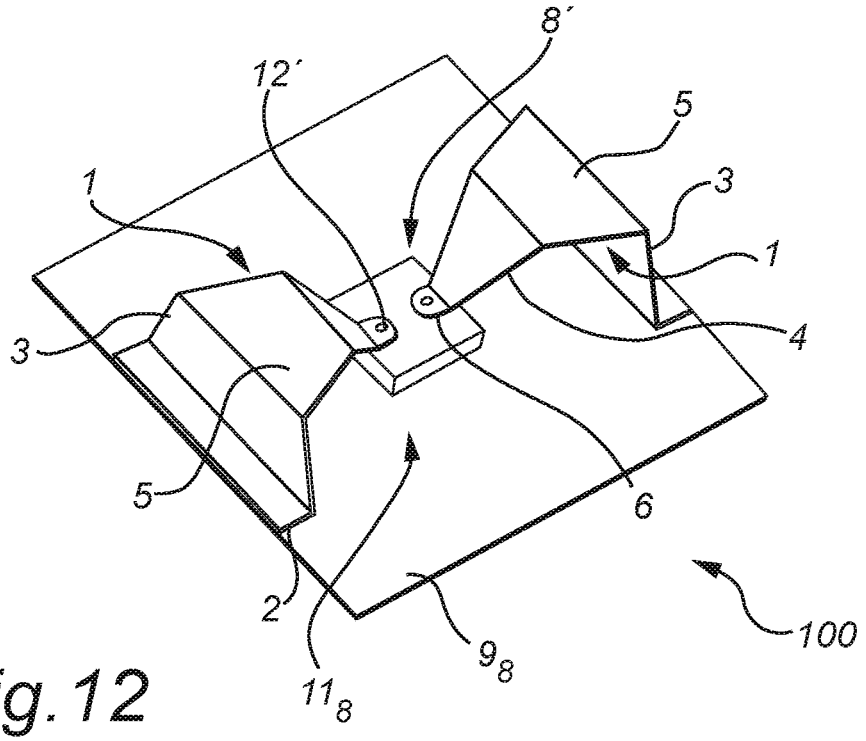
FIG. 12 is a view in perspective of an antenna single-linearly-polarized bowtie antenna element comprising petals without slots and with two antenna ports according to a tenth embodiment of the invention.

FIG. 12 shows an embodiment of a straight sided bowtie antenna arrangement 100 which comprises a bowtie structure $\mathbf{11}_8$ similar to the bowtie structure described with reference to FIG. 1, but with the difference that it comprises a thick dielectric plug 8' as disclosed in FIG. 6B to enhance mechanical strength and stability where the pins and wires are coming through holes in the ground plane, and thus also is appropriate for use for lower frequencies, e.g. for base stations for 3G or 4G frequency bands, requiring larger bowtie structures. In other respects the elements and their functioning is similar to that of corresponding elements described with reference to preceding embodiments and will therefore not be further described herein.

Figure 13:
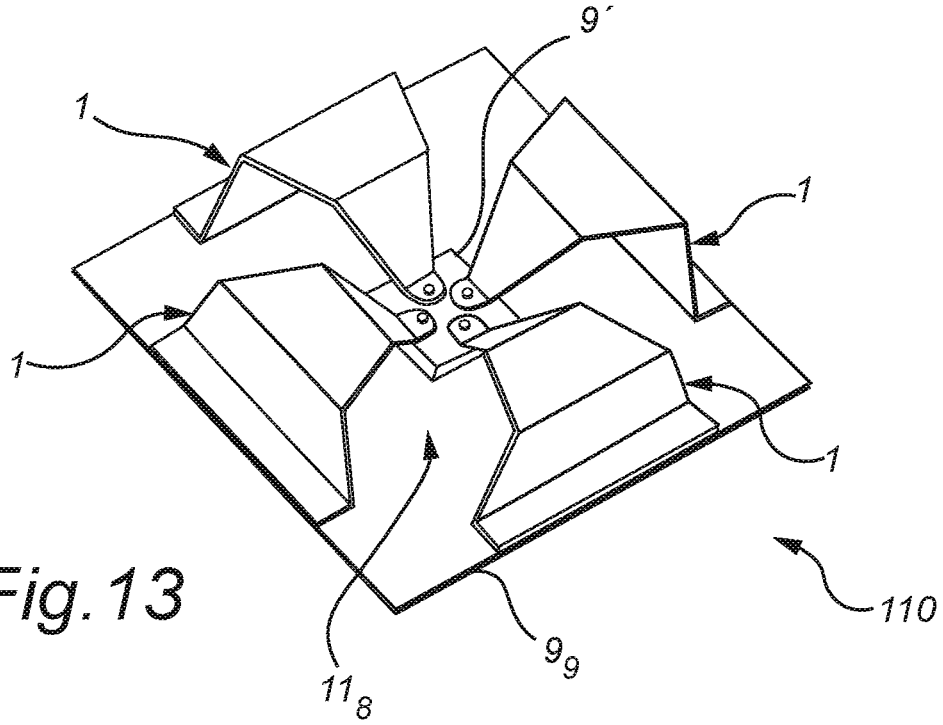
FIG. 13 is a view in perspective of a dual-polarized bowtie antenna element comprising without slots according to an eleventh embodiment of the invention.

FIG. 13 shows an embodiment of a bowtie antenna arrangement 110 which comprises a bowtie structure $\mathbf{11}_9$ similar to the embodiment described with reference to FIG. 2, but comprising a thick dielectric plug 8' as also described with reference to FIGS. 6B and 12. Elements already described with reference to preceding FIGS. 1, 2 and 12 will not be further described here. In some embodiments the four ports are independently excited, whereas in other embodiments the four ports are combined by two baluns, e.g. realized by two 180° hybrids (not shown) disposed on the back (or front) side of the metal ground plane or PCB $\mathbf{9}_9$. The two horizontally polarized ports can then be differentially excited, as well as the two vertically polarized ports, hence providing a two-port antenna with one port for horizontal polarization and one port for vertical polarization.

Figure 14:
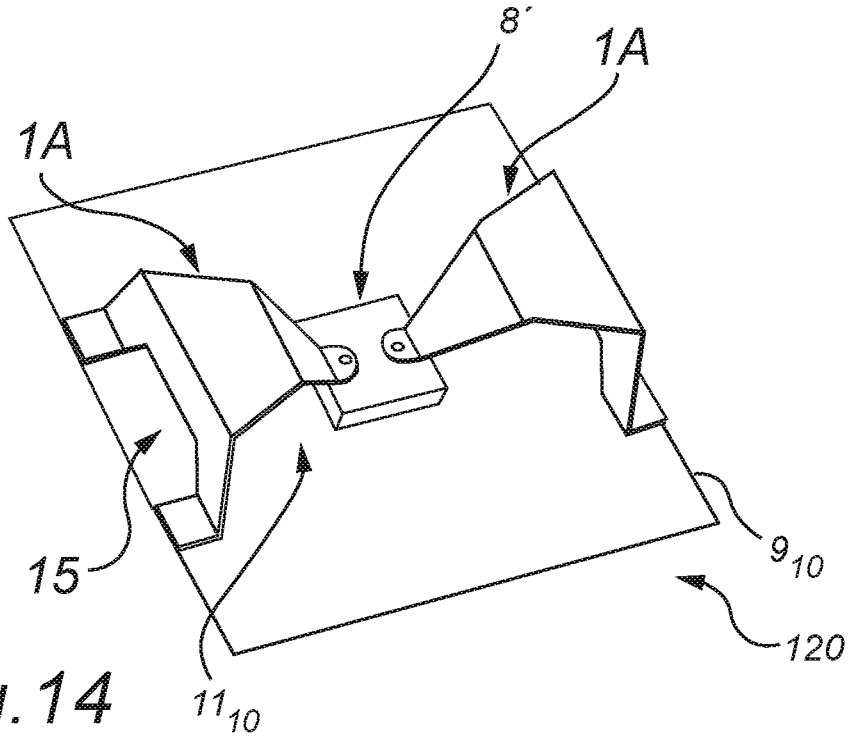
FIG. 14 is a view in perspective of a single-linearly-polarized bowtie antenna element comprising petals with slots as in FIG. 7A and according to a twelfth embodiment of the invention.

FIG. 14 shows an embodiment of a straight sided bowtie antenna arrangement 120 which comprises a bowtie structure $\mathbf{11}_{10}$ similar to the bowtie structure described with reference to FIG. 12, but with the differences the two antenna petals 1A include slots as described with reference to FIG. 7A. Since it comprises a thick dielectric plug 8' enhancing mechanical strength and stability as disclosed in FIG. 6B, it is convenient for use for lower frequencies, e.g. for base stations for 3G and 4G systems, requiring larger bowtie structures. In other respects the elements and their functioning is similar to that of corresponding elements described with reference to the embodiments of FIGS. 6B, 7A, 12 and they will therefore not be further described herein.

Figure 15:
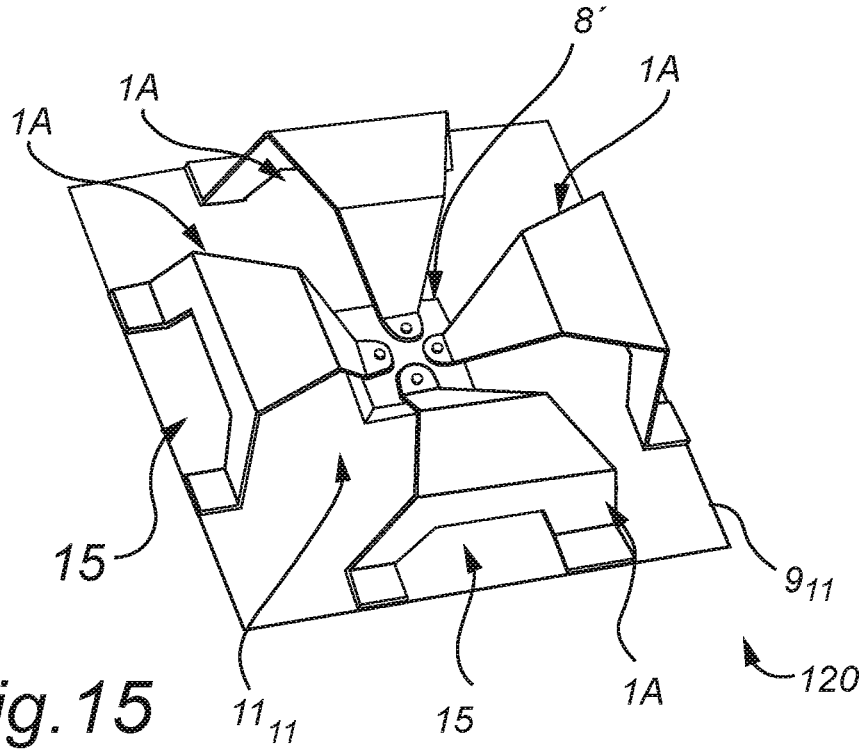
FIG. 15 is a view in perspective of a dual-polarized bowtie antenna element comprising petals with slots as in FIG. 7A according to a thirteenth embodiment of the invention.

FIG. 15 shows an embodiment of a bowtie antenna arrangement 130 which comprises a bowtie structure $\mathbf{11}_{11}$ similar to the embodiment described with reference to FIG. 2, but comprising four antenna elements or four petals 1A as described with reference to FIG. 7A and a thick dielectric plug 8' as also described with reference to FIGS. 6B and 14. Elements already described with reference to preceding FIGS. 1, 2, 6B, 7A and 14 will not be further described herein. In particular embodiments the four ports are independently excited, whereas in other embodiments the four ports are combined by two baluns, e.g. realized by two 180° hybrids (not shown) disposed on the back (or front) side of the metal ground plane or PCB $\mathbf{9}_{11}$. The two horizontally polarized ports can then be differentially excited, as well as the two vertically polarized ports, hence providing a two-port antenna with one port for horizontal polarization and one port for vertical polarization. The bowtie antenna arrangement 130 is particularly suitable for lower frequencies requiring larger bowties, and is advantageous in that performance is enhanced due to the slots as discussed with reference to FIG. 7A.

Figure 16:
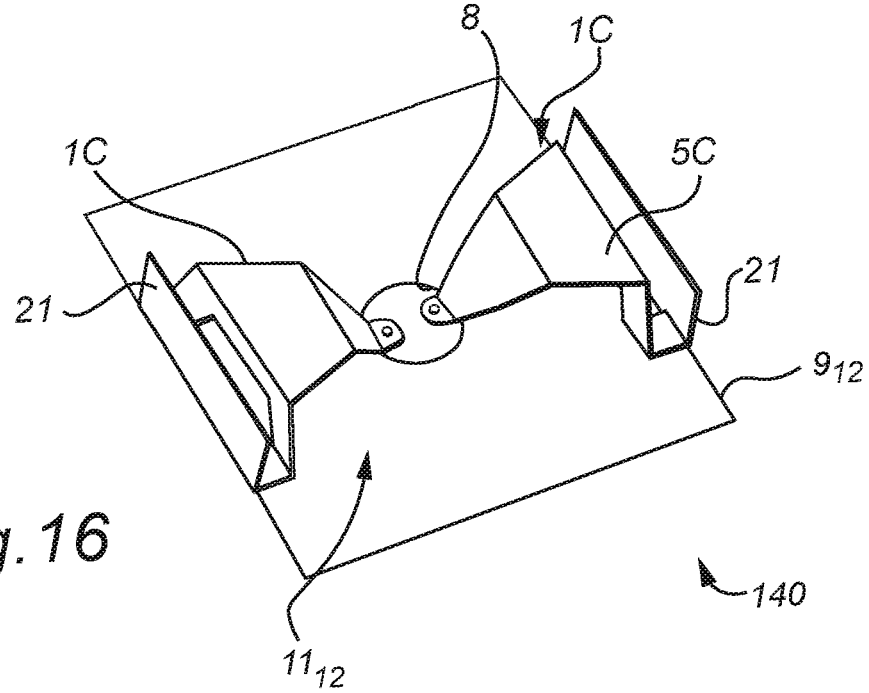
FIG. 16 is a view in perspective of a single-linearly-polarized bowtie antenna comprising petals with slots and with corrugations as in FIGS. 7A and 7B according to a fourteenth embodiment of the invention.

FIG. 16 shows an embodiment of a straight sided bowtie antenna arrangement 140 which comprises a bowtie structure $\mathbf{11}_{12}$ similar to the bowtie structure described with reference to FIG. 1 with the differences that it comprises two antenna petals 1C,1C each comprising a slot as disclosed in FIG. 7A and a wall 21 as disclosed in FIG. 7B to even further enhance the performance as also discussed with reference to FIGS. 7A and 7B. It comprises a central hole 8 in the metal layer of the PCB so that the end tips rest directly on its substrate as disclosed in FIG. 1, and thus is most appropriate for use for higher frequencies, e.g. even up to 100-150 GHz as in other described embodiments. In other respects the elements and their functioning is similar to that of corresponding elements described with reference to the preceding embodiments and will therefore not be further described herein.

Figure 17:
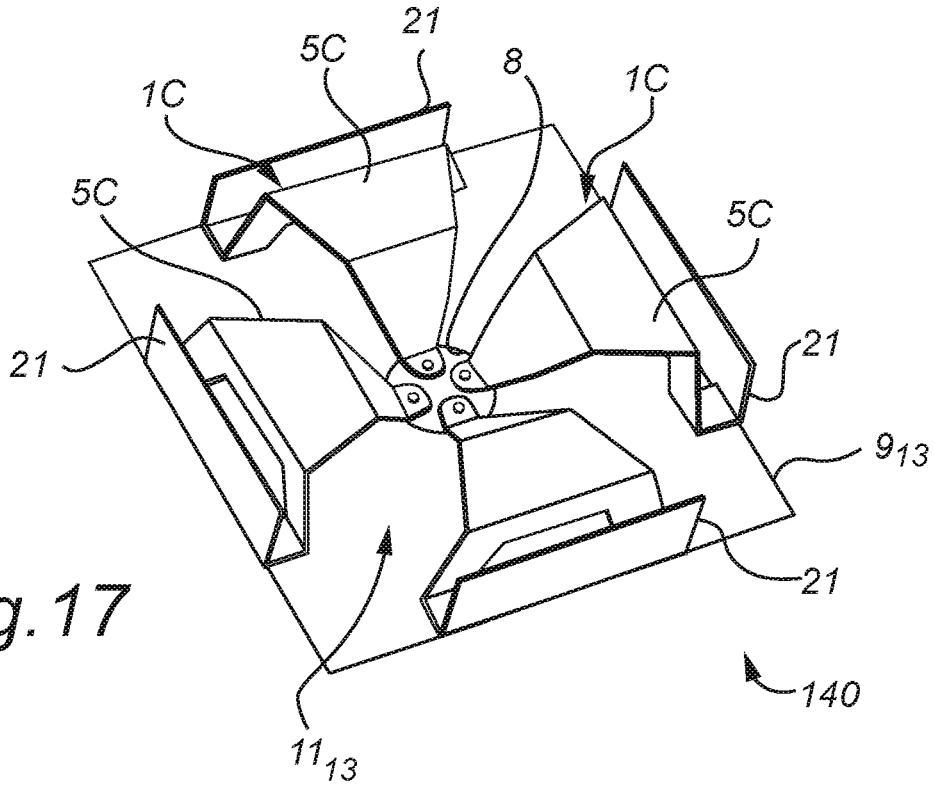
FIG. 17 is a view in perspective of dual-polarized bowtie antenna comprising petals with slots as in FIG. 7A and walls, according to a fifteenth embodiment of the invention.

FIG. 17 shows an embodiment of a bowtie antenna arrangement 150 which comprises a bowtie structure $\mathbf{11}_{13}$ similar to the embodiment described with reference to FIG. 2, but comprising four antenna petals 1C as described with reference to FIG. 16 and a thin dielectric section 8 as also described with reference to FIG. 16 and FIG. 6A. Elements already described with reference to preceding FIGS. 1, 2, 7B and 12 will not be further described herein.

In particular embodiments the four ports are independently excited, whereas in other embodiments the four ports are combined by two baluns, e.g. realized by two 180° hybrids disposed on the back (or front) side of the metal ground plane or PCB $9_{13}$. The two horizontally polarized ports can then be differentially excited, as well as the two vertically polarized ports, hence providing a two-port antenna with one port for horizontal polarization and one port for vertical polarization. The bowtie antenna arrangement 150 can with advantage be used for higher frequencies, e.g. even, but not exclusively, up to 100-150 GHz.

Figure 18:
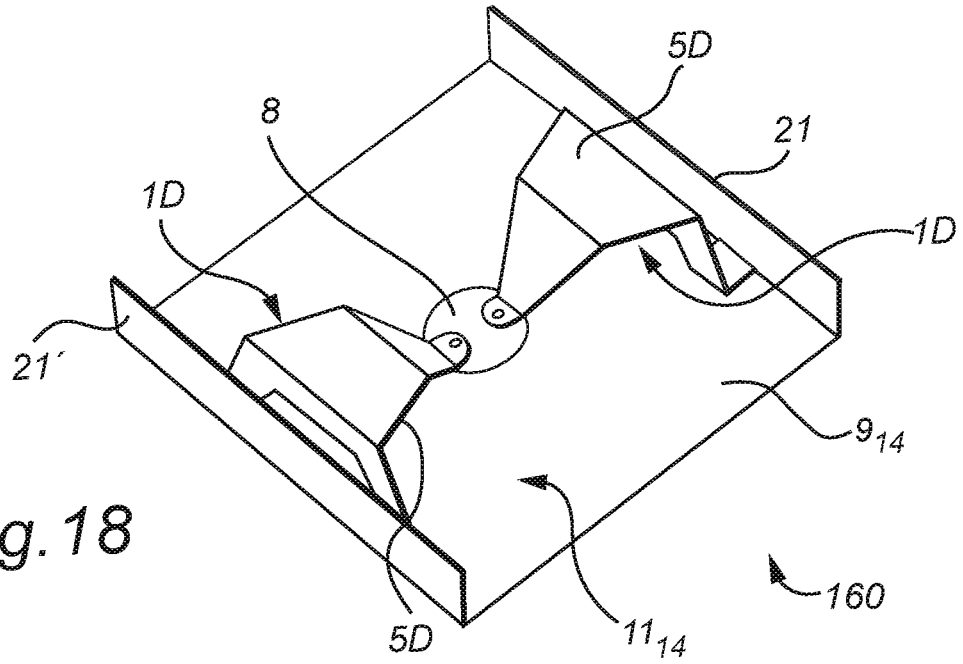
FIG. 18 is a view in perspective of a single-linearly-polarized bowtie antenna comprising petals with slots and with corrugations as in FIGS. 7A and 7B according to a sixteenth embodiment of the invention.

FIG. 18 shows an embodiment of a straight sided bowtie antenna arrangement 160 which comprises a bowtie structure $11_{14}$ similar to the bowtie structure described with reference to FIG. 16, wherein the two antenna petals 1D each comprises both a slot and a wall as disclosed in FIGS. 7A and 7B, but wherein the walls 21' are prolonged to extend all along the respective outer side edges of the PCB $9_{14}$, hence even further enhancing the performance as discussed with reference to FIGS. 7A and 7B. It here comprises a thin dielectric central section 8 as disclosed in FIG. 1, and thus is most appropriate for use for higher frequencies, e.g. even up to 100-150 GHz. In other respects the elements and their functioning are similar to that of corresponding elements described with reference to preceding embodiments and will therefore not be further described herein.

It should be clear that, e.g. for lower frequencies, or to enhance mechanical strength, a thick dielectric plug 8' can be used instead of the thin dielectric central section 8.

In advantageous embodiments the wall 21' has a width approximately corresponding to λ/2, and the height of the wall is substantially λ/4, λ being the signal wavelength.

Figure 19:
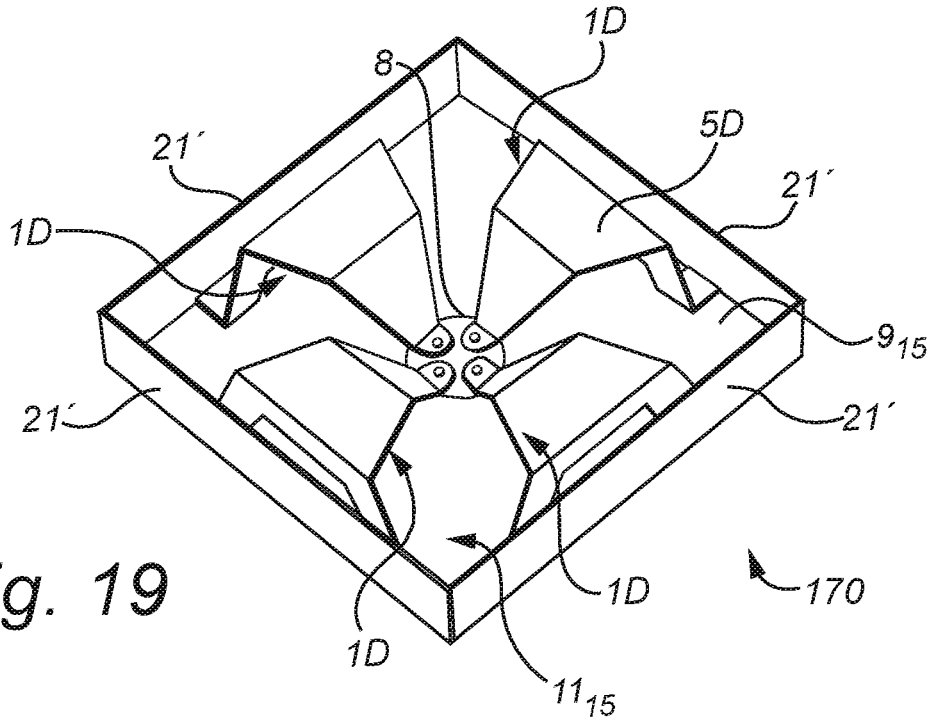
FIG. 19 is a view in perspective of a single-linearly-polarized bowtie antenna comprising petals with slots and walls as in FIG. 17 according to a seventeenth embodiment of the invention.

FIG. 19 shows an embodiment of a bowtie antenna arrangement 170 which comprises a bowtie structure $11_{15}$ similar to the bowtie structure described with reference to FIG. 17, with the difference that the walls 21' are prolonged as described with reference to FIG. 18. Elements already described with reference to preceding FIGS. 1, 2, 7A, 7B and 18 will not be further described here. In particular embodiments the four ports are independently excited, whereas in other embodiments the four ports are combined by two baluns, e.g. realized by two 180° hybrids (not shown) disposed on the back (front) side of the metal ground plane or PCB $9_{15}$. The two horizontally polarized ports, as well as the two vertically polarized ports, can then be differentially excited respectively, hence providing a two-port antenna with one port for horizontal polarization and one port for vertical polarization.

Through the use of petals 1D and extended walls 21', the impedance matching properties will be excellent. The bowtie antenna arrangement 150 can with particular advantage be used for higher frequencies, e.g. even up to 100-150 GHz.

It should also be clear that, also in this embodiment, e.g. for lower frequencies, or to enhance mechanical strength in general, a thick dielectric plug 8' can be used instead of the thin dielectric central section 8.

In advantageous embodiments each wall 21 has a width approximately corresponding to λ/2, and a height of substantially λ/4, λ being the signal wavelength.

In the so far discussed embodiments, the central end portion of the antenna petals are connected antenna feed(s). However, alternatively, the central end portion of each antenna petal may be conductively connected to the ground plane, and arranged in the vicinity of the antenna feed. The antenna feed may here be provided as an excitation opening, such as a slot, in the ground plane, and feeding may e.g. be obtained through microstrip lines having ends protruding into the boundaries of the slot, either directly, or below the slot, e.g. by being arranged on the opposite side of the substrate. The antenna hereby in function resembles a so-called TEM-horn. In the following, some exemplary embodiments of this type will be discussed in more detail.

Figure 20:
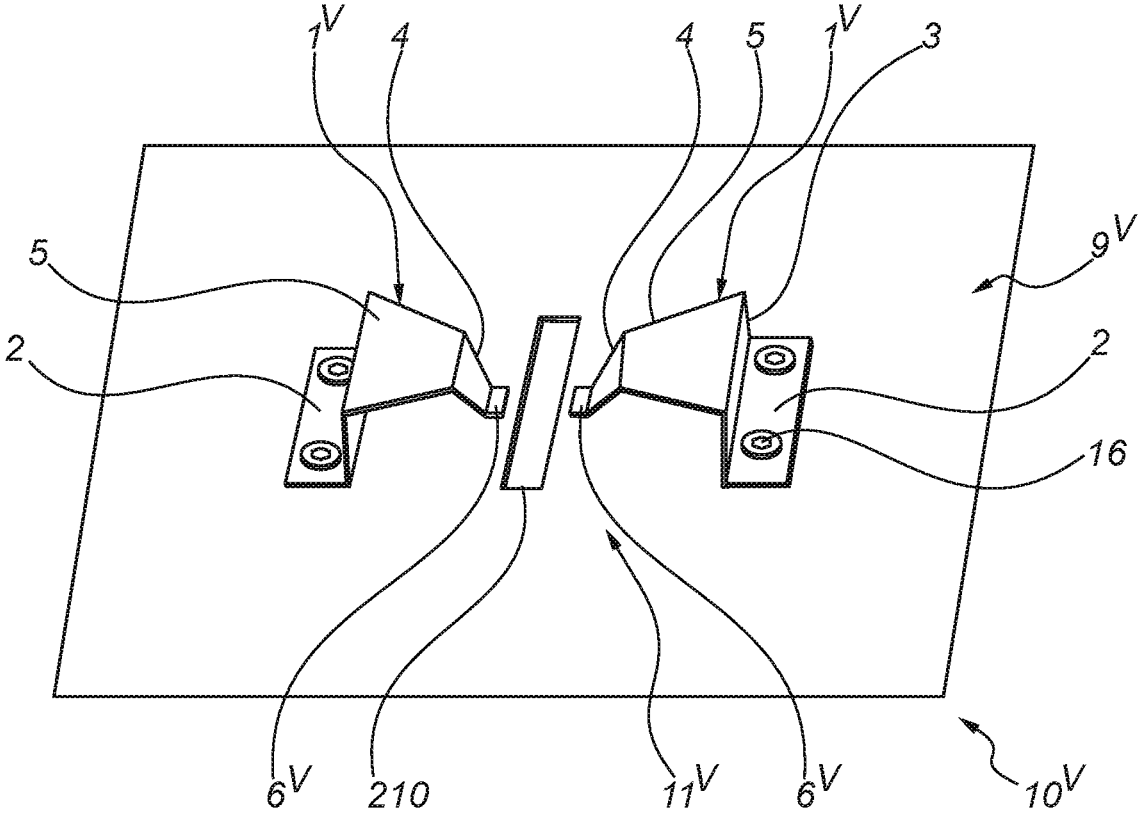
FIG. 20 is a view in perspective of an alternative, eighteenth, antenna arrangement, similar to FIG. 1 in that it also comprises two antenna petals, corresponding to a linearly-polarized bowtie antenna, but being adapted for slot feeding.

FIG. 20 shows still another implementation of an antenna arrangement $10^{v}$, also called an eighteenth embodiment, which is similar to the embodiment of FIG. 1A, but wherein the end portions $6^{v}$ comprise e.g. rectangularly shaped feet, or of any other appropriate shape, adapted to be soldered onto the ground plane $9^5$. Also the first, planar, connecting portions $2^5$ may be soldered onto the ground plane $9^5$, in particular for high frequencies. Alternatively the first, planar, connecting portions $2^5$ may be connected to the ground plane as described with reference to FIG. 1A. The ground plane $9^5$ comprises an etched rectangular slot 210. The ground plane $9^5$ may comprise a PCB (Printed Circuit Board).

In the illustrated example, the end portions/feet extend towards the slot 210. However, alternatively, the end portions/feet may be folded to extend inwardly, away from the slot 210, thereby enabling the inclined surfaces of the antenna petal adjacent to the end portions/feet to be arranged closer to the slot.

The slot 210 may be excited by means of a microstrip line arranged on the lower side the substrate with the ground plane or the PCB. Preferably the length of the slot is λ/4.

Through the use of a slot, hence enabling slot excitation, the use of a balun is rendered superfluous, at least if there only one polarization.

The slot is here shown as a rectangular slot. However, other elongate shapes are also feasible, such as oval shapes and the like. The excitation opening/slot may also be provided with a mid-portion being narrower than the end-portions, such as having a bone shape or an I- or H-shape.

Figure 20A:
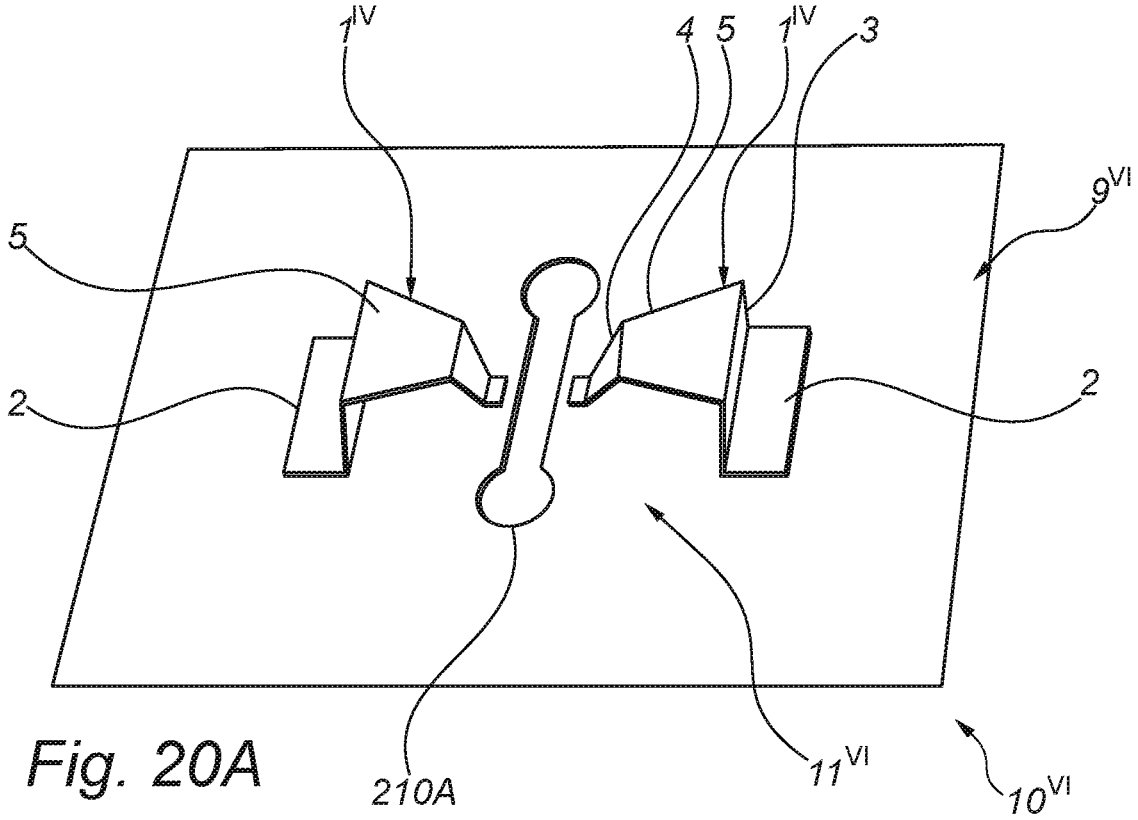
FIG. 20A is a simplified view in perspective of an antenna arrangement as in FIG. 20, but with a different slot shape.

In FIG. 20A an alternative shape of a slot 210' is illustrated, through a bone shaped slot the bandwidth will be increased, hence providing a more wideband arrangement.

Figure 20B:
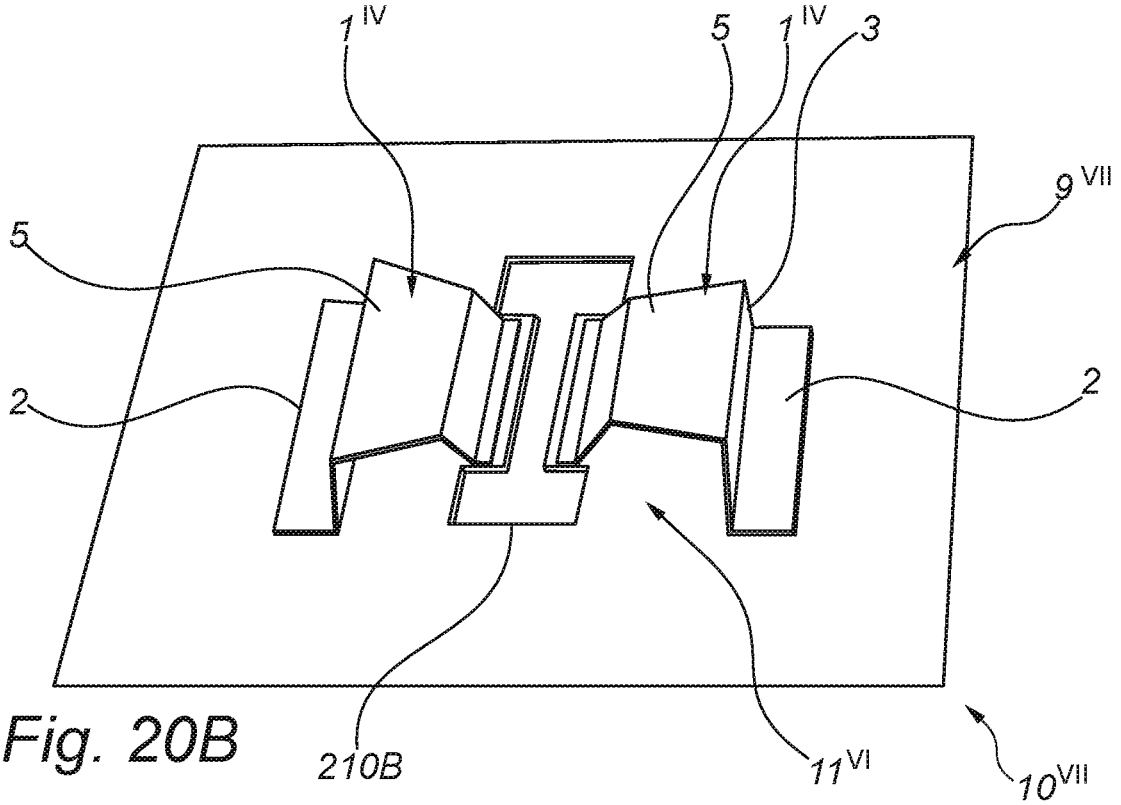
FIG. 20B is a simplified view in perspective of an antenna arrangement as in FIG. 20, but with still another slot shape.

In FIG. 20B a slot 210" having the shape of an H is shown, also in order to enhance the bandwidth of the arrangement.

The end portions may also have a somewhat larger width, e.g. corresponding to the radiating length of the slot. Such as an arrangement is shown in FIG. 20B, where the end portions, approaching or contacting the ground plane close to the slot have a width dimension essentially corresponding to the narrow waist width of the slot.

Figure 20C:
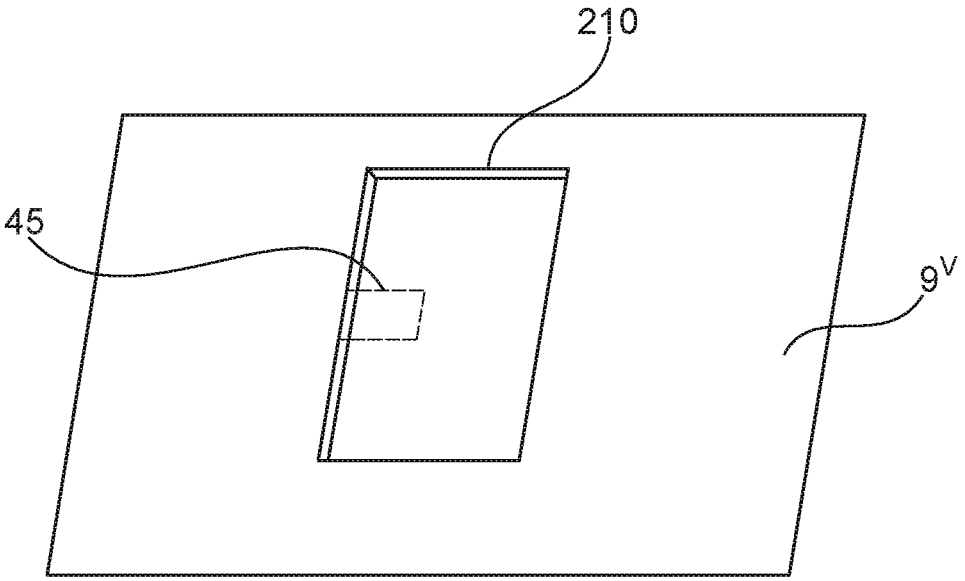
FIG. 20C is a schematic view in perspective from above of a substrate with a slot etched in the ground plane.

FIG. 20C is a top view in perspective showing a ground plane $9^5$ in which a slot 210 is etched, such that the substrate 211 can be seen. Below the substrate, perpendicularly to the longitudinal extension of the slot 210 a microstrip line 212 is provided, extending substantially to the center in the width direction of the slot 210, thereby protruding into the bounds of the slot.

Figure 20D:
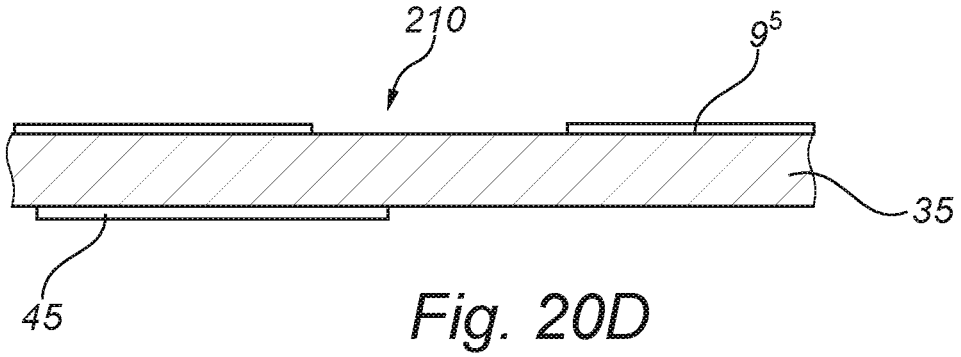
FIG. 20D is simplified cross-sectional view of the substrate with a slot in FIG. 1E, and a microstrip line arranged below the substrate.

FIG. 20D is a simplified cross-sectional view showing the substrate 211 with the slot 210 and the microstrip 212 arranged below the substrate 211, in an arrangement corresponding to FIG. 20C.

Figure 21:
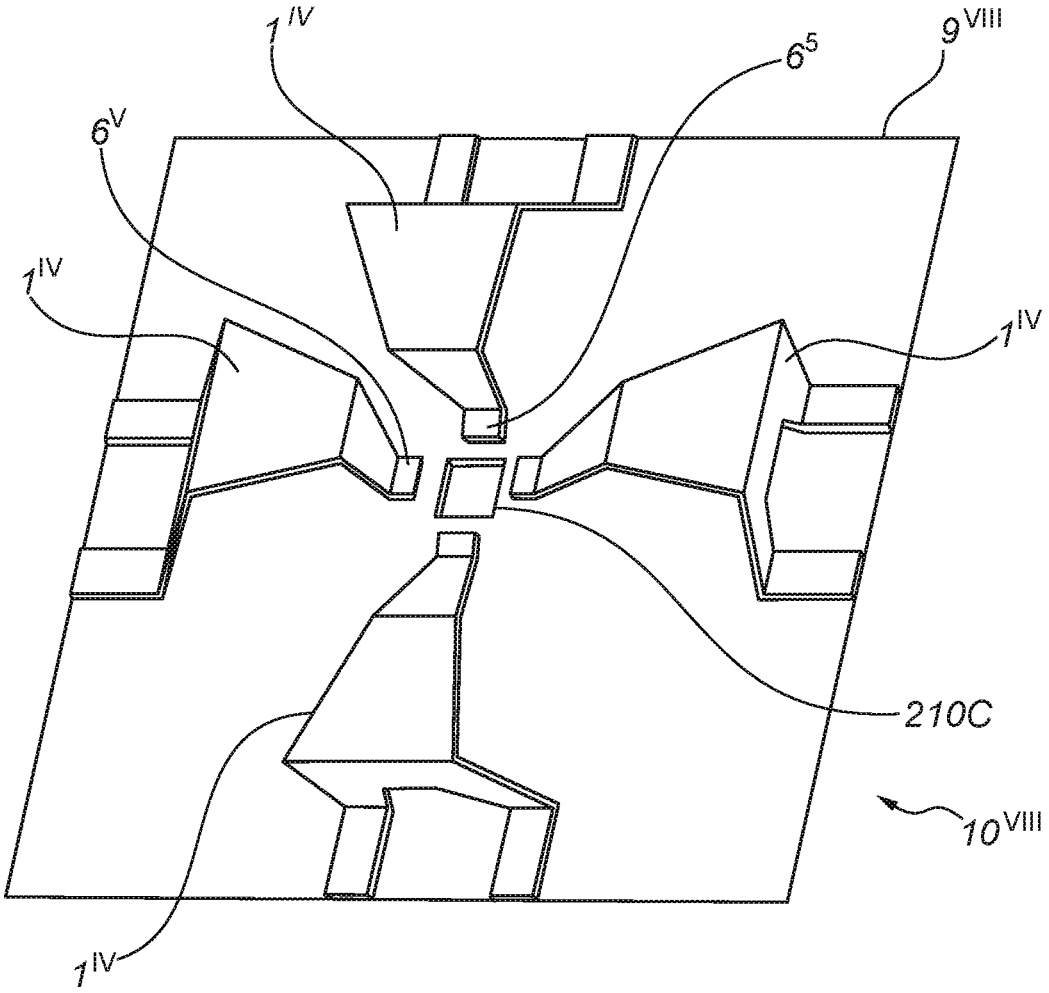
FIG. 21 is a view in perspective of an alternative, nineteenth, antenna arrangement, similar to FIG. 8 in that it also comprises a dual-polarized bowtie antenna element comprising four antenna petals, but being adapted for slot feeding.

FIG. 21 illustrates an antenna arrangement similar to the one discussed in relation to FIG. 8, but with a slot feeding arrangement similar to the one discussed above in relation to FIGS. 20A-D. The antenna petals comprise end portions/feet $6^5$ connected to the ground plane $9^{VIII}$. As discussed in the foregoing, the end portions/feet may, even though illustrated as extending towards the slot 210C, may instead be back folded, and directed away from the slot. In this embodiment, four antenna petals are provided, and consequently, the slot preferably has the same dimensions in both directions. The slot may be shaped as a square, as illustrated in the figure, but may also have other symmetrical shapes, such as being square with rounded corners, being circular or the like.

Figure 21A:
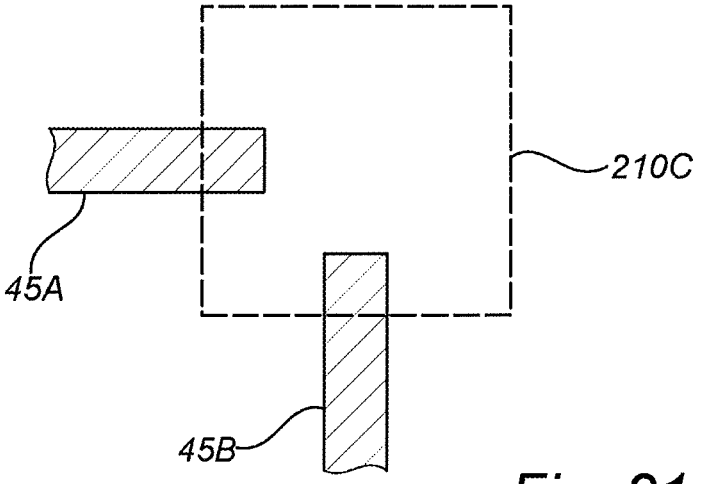
FIG. 21A is a schematic view from below of a substrate with a slot etched in the ground plane with microstrip lines arranged below the substrate for excitation.

FIG. 21A is a top view in perspective showing a ground plane in which a slot 210C is etched, such that the substrate can be seen. Below the substrate, perpendicularly to the length and width extension of the slot 210C microstrip lines 45A and 45B are provided, extending substantially to the center in the width and length direction, respectively, of the slot 210C, thereby protruding into the bounds of the slot.

The microstrips 45A and 45B here extend into the boundaries of the slot from different angles, and preferably perpendicularly, as in the illustrative example, for provision of a dual polarization.

Figure 21B:
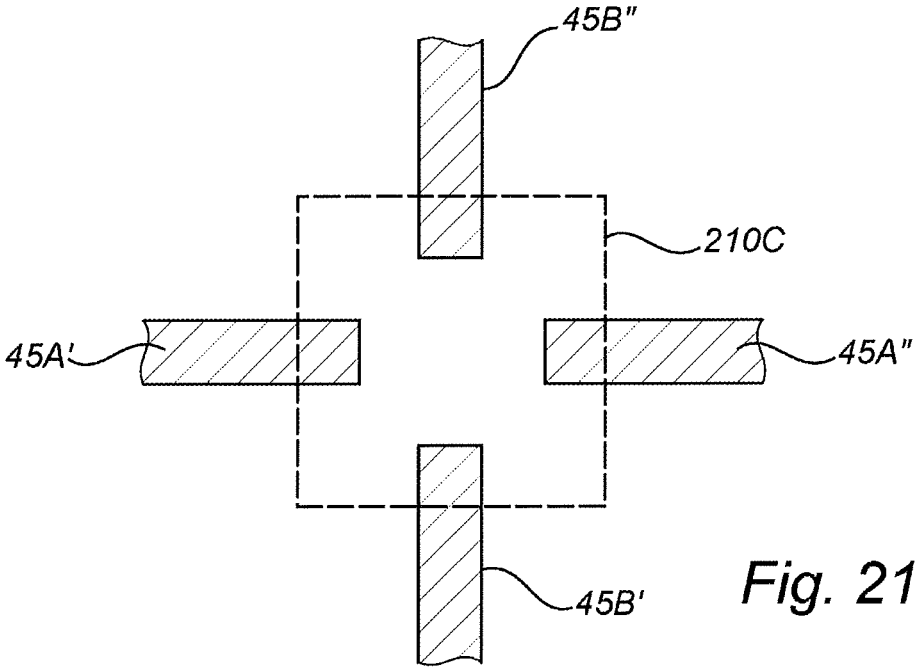
FIG. 21B is a schematic view from below of a substrate with a slot etched in the ground plane feeding microstrip lines arranged below the substrate for excitation according in an alternative implementation.

Alternatively, as illustrated in FIG. 21B, two oppositely arranged microstrips 45A', 45" and 45B', 45", respectively, may be provided in each direction, thereby providing a more uniform radiation pattern.

FIGS. 22A-22G show different antenna petal profiles and slot shapes, illustrated in the unfolded state. The dashed lines in the Figures indicate folding lines.

An antenna petal according the invention may be cut out or punched, with or without slots, and subsequently folded in a machine. Alternatively, the cutting or punching operation and the folding or bending operation may be carried out in one step in a machine or using an appropriate tool.

Figure 22A:
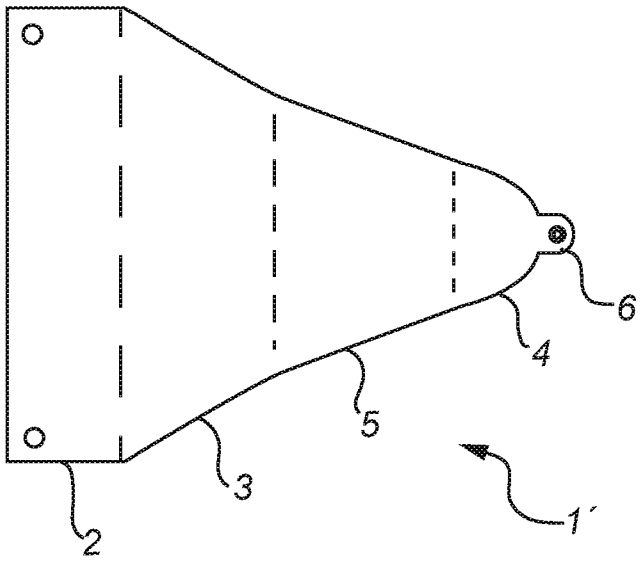
FIG. 22A is a top view of an antenna petal element similar to the antenna petals shown in FIG. 1 before being folded or bent.
Figure 22B:
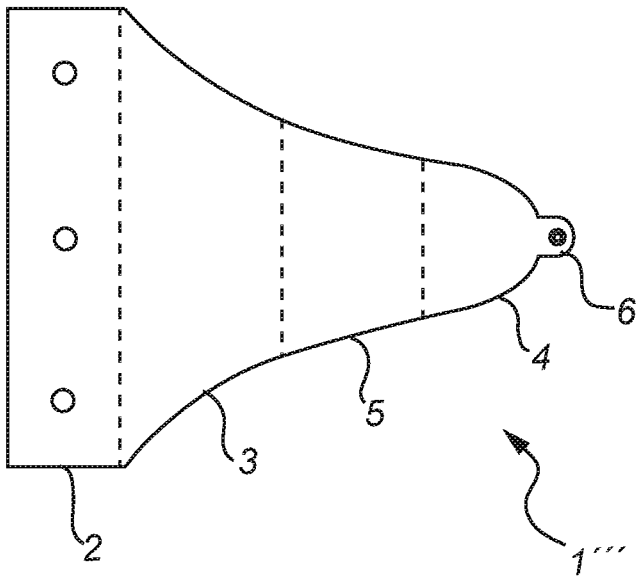
FIG. 22B is a top view of an antenna petal element similar to the antenna petals shown in FIG. 1 but with a slightly modified shape before being folded or bent.

Examples of antenna petals 1',1'", e.g. having shapes similar to that of the antenna petal shown in FIG. 1, without any slots are shown in FIGS. 22A, 22B. In other respects the antenna petals 1' of FIG. 22A and 1'" of FIG. 22B are similar to the antenna petal of FIG. 1, and will therefore not be further described herein, and the same reference numerals are used.

The other different antenna petal elements or profiles have slots along the edges (FIG. 22F, FIG. 22G) or in the central part (FIGS. 22C, 22D, 22E, 22G) of the petal. These shapes are only examples of possible profiles and slots covered by the invention.

The petal profiles and the slots are optimised in order to change the current traces on the petals in such a way that the embedded element pattern of the single-, or dual-polarized bowtie element gets the desired coverage and impedance match over the desired bandwidth. Typically, slots in the wide part of the antenna petal far from the second connecting end tip portion will affect the performance at low frequency, and slots close to the first connecting portion will affect the low frequency performance.

The optimisations are normally done by cut-and-try approach, but they can in more advanced studies be done by advanced numerical optimisation using generic algorithms.

Figure 22C:
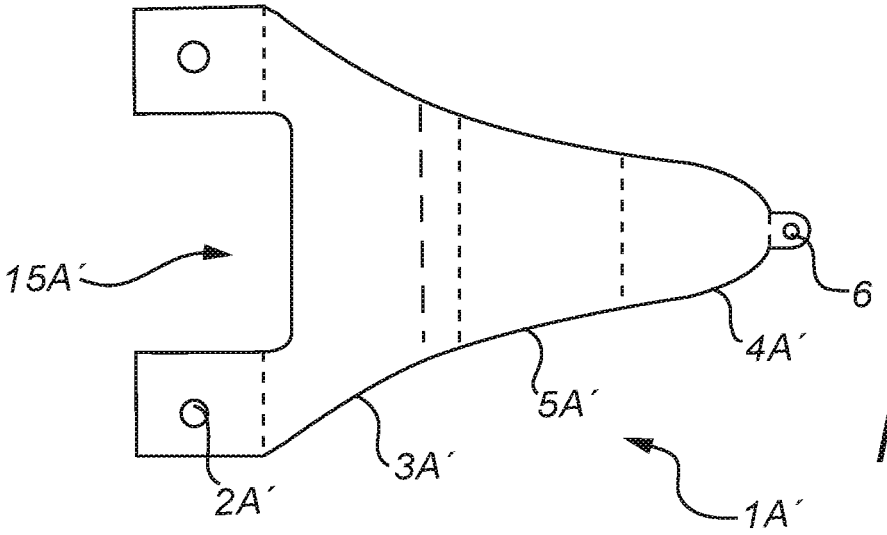
FIG. 22C is a top view of an antenna petal element substantially similar to the antenna petal shown in FIG. 7A before being folded or bent.

Particularly, FIG. 22C shows an antenna petal 1A' with an open slot 15A' substantially similar to the embodiment shown in FIG. 7A, and therefore the same reference numerals are used for other parts of the antenna petal.

Figure 22D:
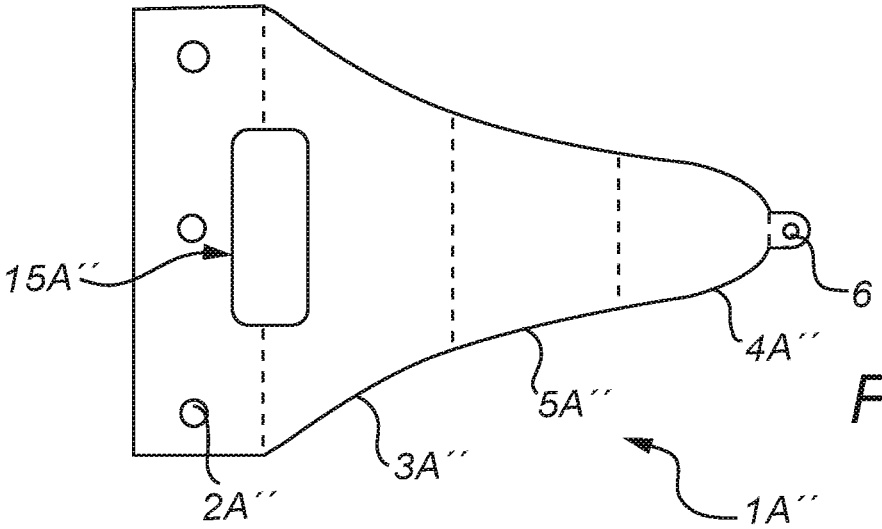
FIG. 22D is a top view of an alternative antenna petal element with a slot before being folded or bent.

FIG. 22D shows an antenna petal 1A" with a slot 15A" provided in the first wall portion 3A", and optionally also partly in the first connecting portion 2A". The slot 15A" is closed, and substantially of a rectangular shape in parallel with the longitudinal extension of the first connecting portion 2A". For the other elements similar reference numerals are used as in FIG. 1, but referenced with a double prime sign.

Figure 22E:
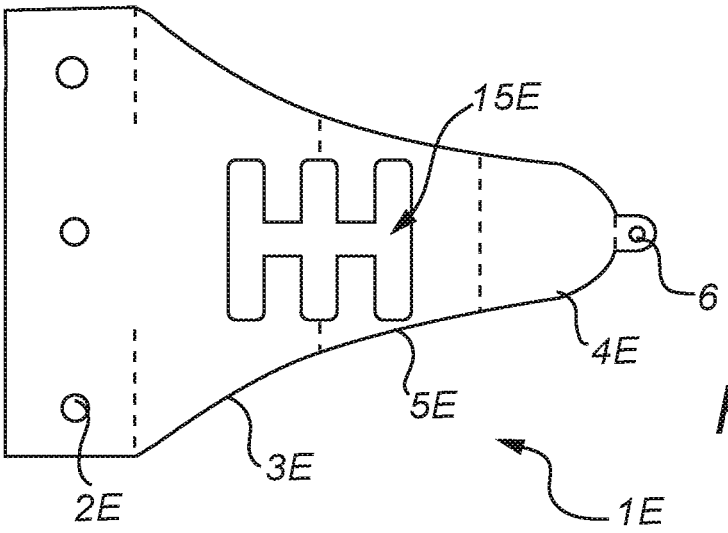
FIG. 22E is a top view of another alternative antenna petal element with a slot before being folded or bent.

FIG. 22E shows an antenna petal 1E with an inner centre slot 15E provided in the first wall portion 3E, and also in the intermediate mounting portion 5E. The slot 15E is closed, centrally located and is tooth- or comb-shaped. For the other elements similar reference numerals are used as in FIG. 1, but indexed with an E.

Figure 22F:
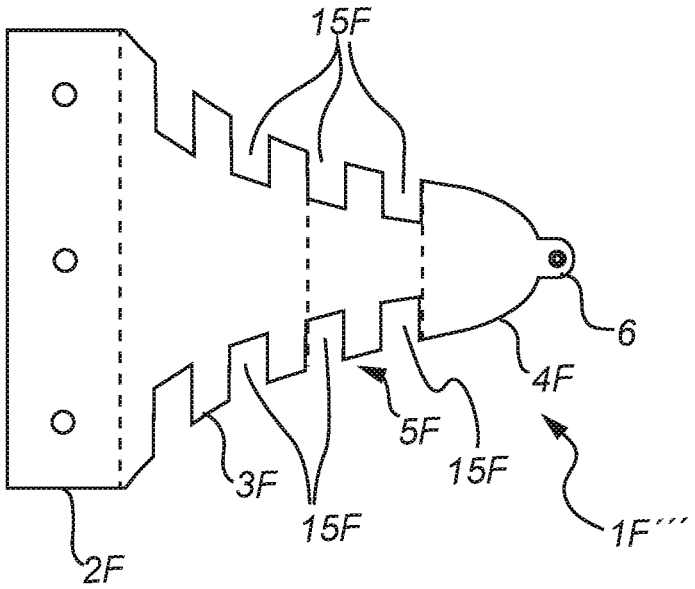
FIG. 22F is a top view of still another alternative antenna petal element with edge slots or cut-outs before being folded or bent.

FIG. 22F shows an antenna petal 1F with external edge slots 15F,15F provided e.g. along at least part of the outer sides of the first wall portion 3F, the intermediate mounting portion 5F and the second wall portion 4F. The slots 15F,15F are tooth- or comb-shaped. For the other elements similar reference numerals are used as in FIG. 1, but indexed with an F.

Figure 22G:
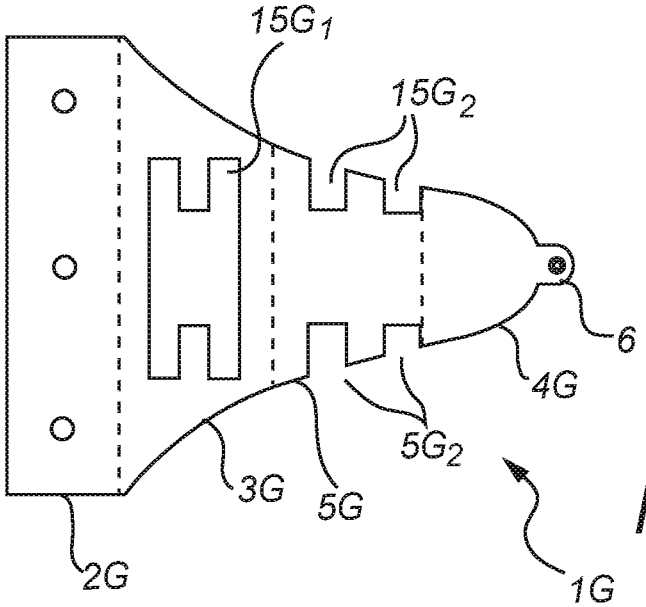

FIG. 22G shows an antenna petal 1G with external edge slots 15$G_2$,15$G_2$ provided e.g. along at least part of the outer sides of the second wall portion 4G, and an inner, closed, tooth-shaped centre slot 15$G_1$ provided in the first wall portion 3G, and the intermediate mounting portion 5G. For the other elements similar reference numerals are used as in FIG. 1, but indexed with a G.

In some embodiments the periodic distance between antenna petals in an array (between center points thereof) is about 0.5λ, but it may also assume other values, e.g. it may be larger. The height above the ground plane may be between 0.2 and 0.5λ, but of course these values are also merely given for exemplifying reasons. In some embodiments the relative bandwidth is at least 1.6.

Antenna petals arranged on opposite sides of the slot may also be connected by a narrow metal connection, partwise forming the walls of a horn. Thus, two or more antenna petals may be formed into monolithic, unitary units, which may be arrangeable on the ground plane by surface mount technology.

Figure 23A:
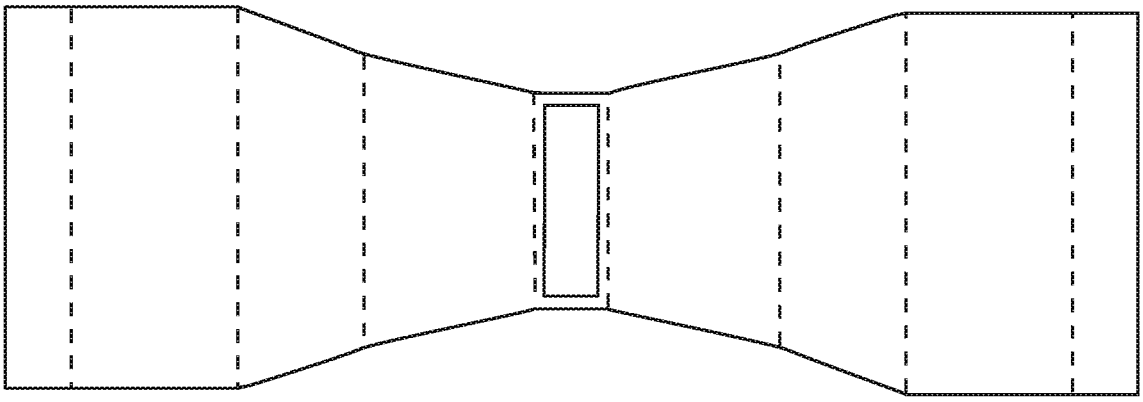

In FIGS. 23A and B, such an embodiment is schematically illustrated. In FIG. 23A, a metal sheet is illustrated, which is cut or formed to form two oppositely arranged antenna petals, surrounding a slot feed as discussed in the foregoing. The dashed lines illustrate the preferred bending lines. In FIG. 23A, the same antenna petals are shown in a bent state, where the antenna petals form slanted surfaces adjacent the slot feed.

Figure 24A:
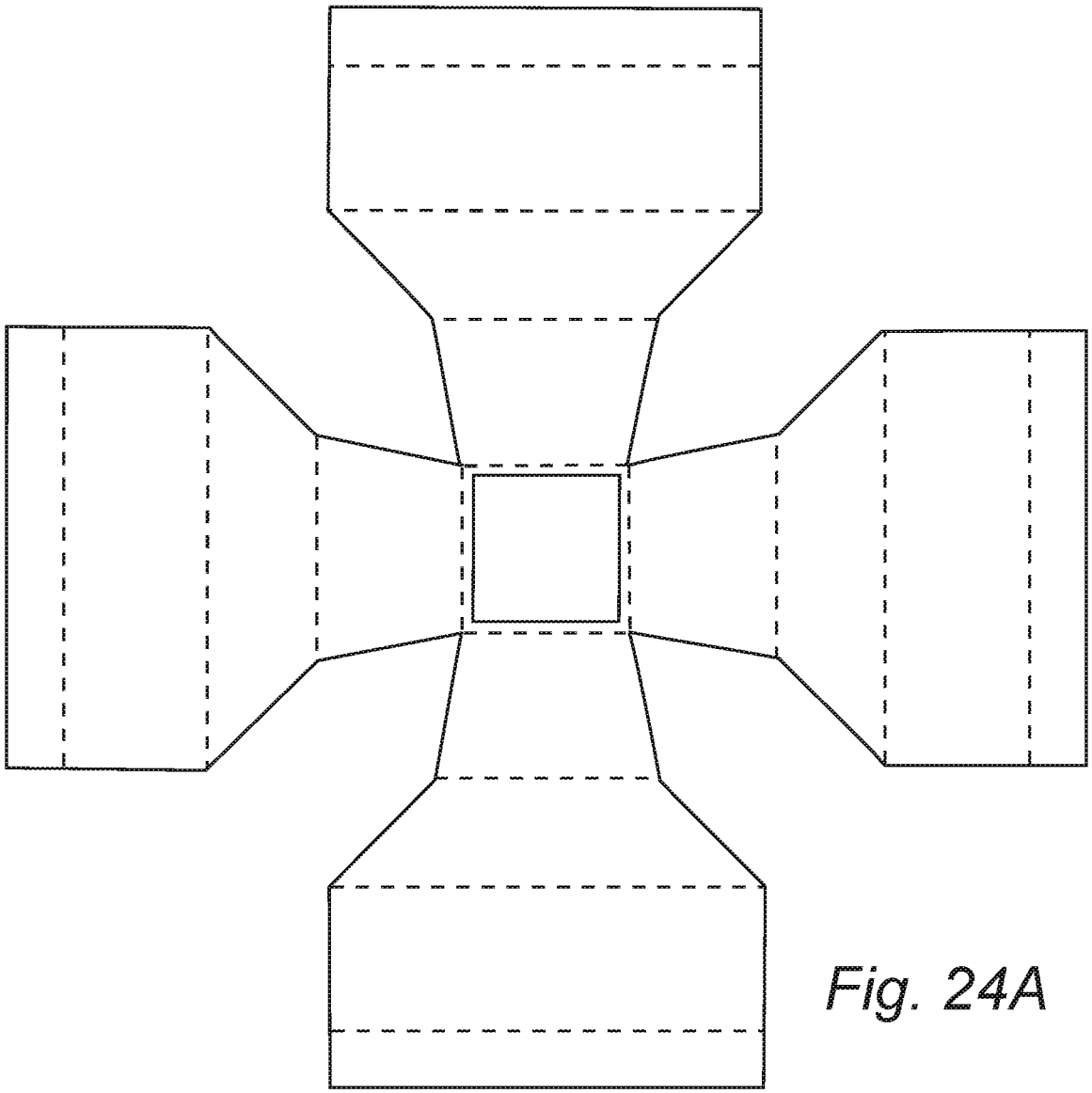
FIG. 24A is a top view of a metal sheet, before bending.
Figure 24B:
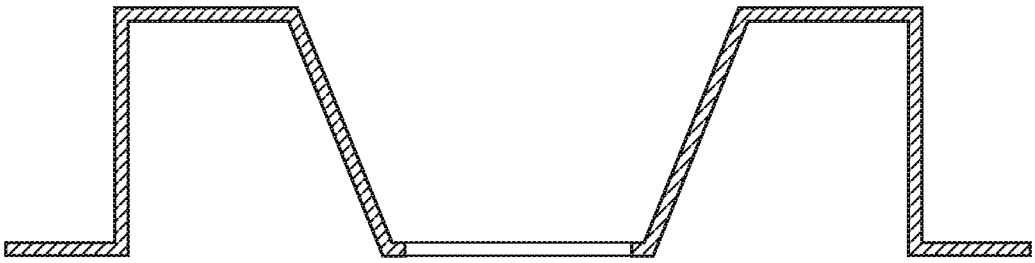
FIG. 24B is a cross-sectional view of the same metal sheet in a bent state.
Figure 24C:
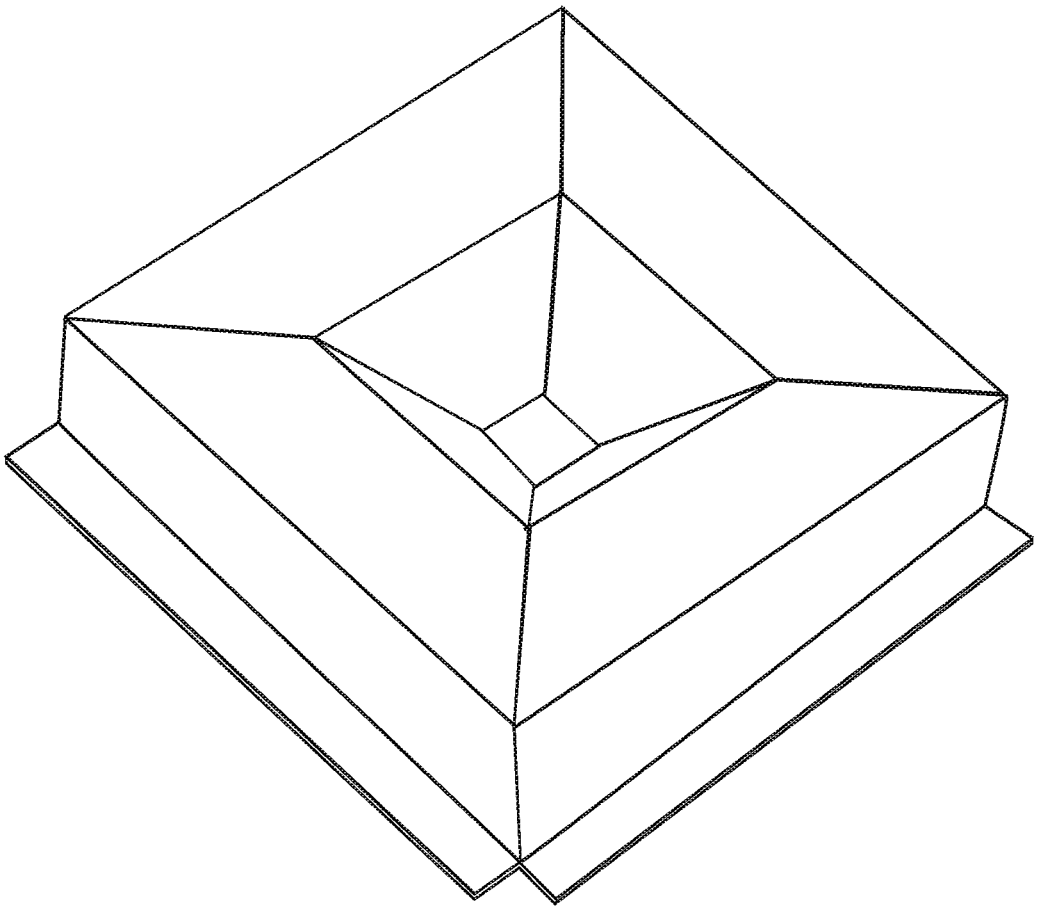
FIG. 24C is a perspective view of the same metal sheet in a bent state.

In FIG. 24A-C illustrates a similar type of antenna petal being connected around the rims of the slot feed, but with four antenna petals. Here, a continuous connection around the slot may be provided, connecting all the four petals together. This embodiment is particularly suited for a dual-polarized bow-tie antenna, as discussed in the foregoing.

The connection between the opposite antenna petals is optional, as has already been shown in several of the above-discussed embodiments. Further, if there is a connection between opposite antenna petals, this connection can preferably be made very narrow.

Figure 23B:
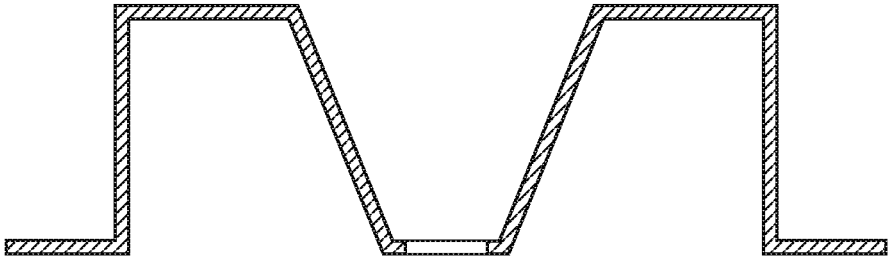
Figure 25A:
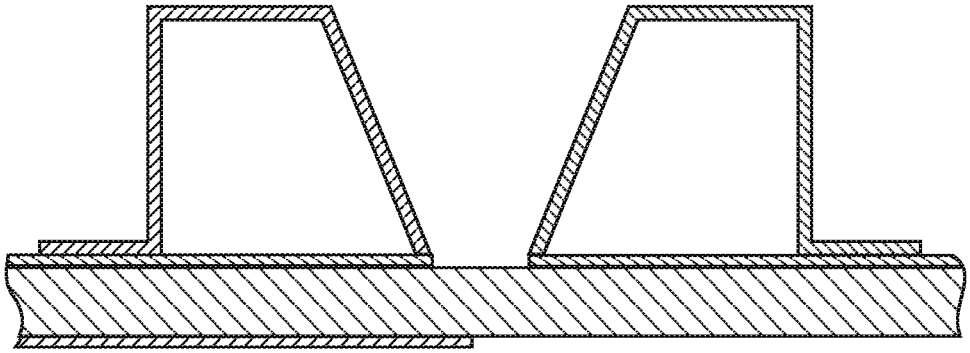
FIGS. 25A and 25B show a cross-sectional view of an antenna in accordance with another embodiment (FIG. 25A), and an antenna petals unit for forming said antenna in a perspective view (FIG. 25B).
Figure 25B:
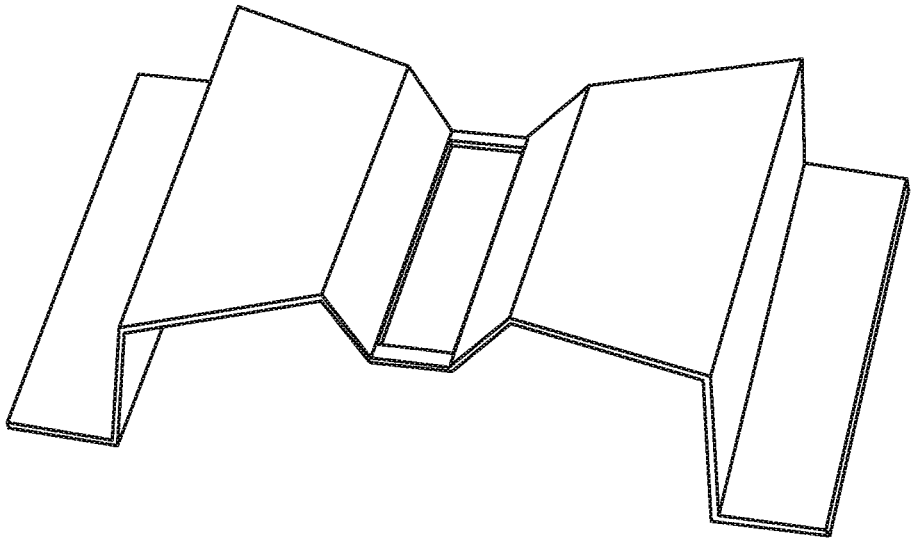

In FIG. 25, such an embodiment having a very narrow, or even non-existent distance between the rim of the slot feed and the slanting surfaces of the antenna petals is shown. In this embodiment, two antenna petals are formed in a single, monolithic unit, having connections there between, extending along the rim of the slot feed, to form, partwise, the walls of a horn, similar to the embodiment of FIG. 23. Here, however, the slanting wall of the antenna petals are arranged close to, or even in direct contact, with the rim of the slot feed. Thus, the slanting walls of the antenna petals are hereby in direct contact with the edges of the slot.

The antenna petals can be produced by cutting or forming a metal sheet into a desired form, and then bending it, by machine processing, to a desired shape. However, it is also possible to use form-pressing, coining and the like to form the metal sheet into a desired form. Still further, it is also possible to use injection molding and the like. In particular, it is feasible to form a dielectric material into a desired shape, and form a metal layer on top of it, e.g. by conventional metallization.

It should be clear that different antenna petals and different arrangements, geometries and numbers of petals can be used and combined to provide different bowtie structures in any desired manner, and also be combined with thin dielectric sections or thick dielectric plugs to provide for different desired properties, depending on intended applications and used frequencies. In some embodiments petals with slots are only used along the outer edges of e.g. an array of bowtie structures.

It should also be clear that any connectors, e.g. coaxial connectors, may be provided for and arranged in any desired manner.

The ports may comprise coaxial connectors with centre conductors that connect microstrip transmission lines and/or baluns to respective conducting elements 12, said microstrip lines and/or baluns being arranged on the front or back side of the conducting ground plane or the PCB.

Through the use of appropriate electronics, antenna arrays with controllable lobes are provided which are useable for several, in particular high frequency applications, e.g. in Massive MIMO base stations.

The antenna petals may also have other shapes than explicitly shown in the exemplifying embodiments. They may e.g. have a shape tapering towards the end tips in a symmetric or in a non-symmetric manner, starting with a rapidly tapering region after which the respective arm section is narrow and then taper regularly towards the end tip portion. It should be clear that the shape of the antenna petals can be chosen and optimized in different ways; only a few advantageous embodiments are shown. The two side edges of an arm section may e.g. taper symmetrically but irregularly, being straight or curved or a combination of both. The petals may also have more slots in them than the ones marked as 15, and also in other portions of the petals.

Preferably the petal is made in one piece, which is cut or punched out of a piece of metal, with or without one or more slots, wall etc., and then folded, bent or pressed into the desired shape, or alternatively pressed or folded and punched or cut in one step. The petals are then e.g. soldered onto the conducting ground plane or the PCB. The first connecting end 2 may also or alternatively have mounting holes for fixing it to the ground plane by using screws or pop rivets.

The antenna elements may be made of a conductive material comprising metal, e.g. Cu, Al, or a material with similar properties, or an alloy.

Different mounting elements (not shown) can be provided for in any appropriate manner in order to allow for easy and reliable mounting of the antenna arrangement wherever desired, for example on the top of a mast, on a wall, at a micro base station etc.

It should be clear that the widths and shapes of conductors may be different, where the conductors are located may differ, and the types and arrangement of conducting wires and pins, as well as the arrangement of holes in the metal surface on the central portion of the PCB may be differently implemented. Also the shape of the dielectric central portion, although preferably being circular, square shaped or rectangular, may be different and may also have any other shape, for example triangular or hexagonal etc. The antenna arrangements may in some applications be used for wall mounting as a wall antenna with approximately a hemispherical coverage.

Embodiments of an antenna arrangement comprising but one single antenna petal are also covered by the inventive concept. The end tip portion of the petal is then in a similar manner via e.g. a conducting pin connected to, for example a microstrip line, e.g. on the back side of the central portion. A coaxial connector may be provided at an outer edge located distant from the end tip portion or elsewhere at any other appropriate location. It should be clear that other conductor types can be used, as well as other types of connectors.

An antenna arrangement may comprise a non-directional antenna arrangement comprising a number of antenna structures mounted on the PCB or conducting ground plane with, in e.g. a central portion, comprising separate, or for some petals, common, openings for the conducting elements.

The inventive concept also covers antenna arrangements comprising e.g. three or any other odd number of antenna petals, wherein the petals are so disposed that the end tip portions end at a slight distance from each other. Conducting pins connect the end tip portions via openings with conductors or coaxial connectors (not shown) e.g. located on the back side of the PCB or the conducting ground plane.

With a three port bowtie antenna (i.e. an arrangement with three petals), a particularly low coupling between ports can be achieved.

Thus, with three petals a particularly compact antenna with a low or substantially no coupling between ports can be provided, e.g. suitable for wall mounting.

It should be clear that the antenna arrangements as described also may be provided as double sided arrangements, i.e. with such antenna arrangements arranged back-to-back e.g. for mounting on a mast or similar, hence providing for spherical coverage instead of a hemispherical coverage.

In one implementation an antenna arrangement comprising a plurality of antenna petals, via mounting element, may be mounted on the top of a mast. Connectors may e.g. be arranged on the edges of the conducting ground plane or the PCB in order to be easily accessible.

It is a particular advantage of the invention that antennas with multiple ports are provided which are suitable for MIMO systems, particularly Massive MIMO systems, and which are highly uncoupled (such that variations on channels will be different, avoiding that all channels have a low level at the same time).

It is a particularly an advantage that a MIMO antenna, particularly an antenna that can be used as an element in a Massive MIMO array for 5G, which additionally is very small and compact and can be made in a very cheap, easy and automated manner and that the antenna petals very easily can be mounted in a fast manner. Moreover it is a most particular advantage that a bowtie antenna arrangement is provided which has a very high bandwidth, e.g. up to octave bandwidth or even more.

In some embodiments it may have dimensions smaller than one third of the lowest operating frequency. It is also an advantage that an antenna arrangement is provided which has a low correlation between different antenna ports when it is used in a statistical field environment with multipath, e.g. as low as 0.1 over 0.4-16 GHz in an arrangement with four antenna elements although they are located very close to one another. Such a low correlation can be assured by designing the multi-port antenna for having low mutual coupling measured between its ports (i.e. S-parameters $S_{mn}$, scattering parameters, smaller than typically −10 dB). It is also an advantage that a large angular coverage can be provided, by all ports together, for example 360° for some implementations, or that antenna elements easily and flexibly can be arranged so as to together provide a desired angular coverage when the received voltages on all ports are combined digitally by a so called MIMO algorithm. An example of such an algorithm is Maximum Ratio Combining (MRC).

In one application it may comprise a linear array used to feed a parabolic cylinder that e.g. can be used in an OTA (Over-The-Air) test system for wireless communication to vehicles. Then, the linear array in combination with the cylindrical parabolic reflector create a plane wave illuminating the vehicle, e.g. a car.

The invention is not limited to the illustrated embodiments, but can be varied in a number of ways within the scope of the appended claims.

The invention claimed is:

1. A self-grounded antenna arrangement comprising an antenna structure comprising a number of antenna petals comprising arm sections tapering towards end portions of the antenna petals, the end portions of the antenna petals being arranged adjacent to each other, and comprising or being made of an electrically, conducting material, the end portions being arranged to approach a base plate, and an antenna feed arranged connected to or in the vicinity of said end portions wherein the base plate comprises a conducting ground plane or a Printed Circuit Board working as a ground plane, that each antenna petal is made in one piece, or two or more antenna petals are combined to one piece, and comprises a metal surface, and in that the, or each, antenna petal is adapted to be fabricated separately from the conducting ground plane or the Printed Circuit Board, and to be mountable onto a front or back side of the base plate by means of surface mounting technology, wherein each antenna petal comprises a first planar connecting portion adapted for connection to the front side of the conducting ground plane or the PCB, a first wall portion forming an angle with the plane in which the first connecting portion extends, an intermediate mounting portion, which is arranged to interconnect said first wall portion with a second wall portion in an opposite end connecting to, or turning into, a second connecting portion, including said end portion, disposed in the same plane as the first connecting portion.

2. The self-grounded antenna arrangement according to claim 1, wherein the end portion of each antenna petal is connected to one or several antenna feed(s).

3. The self-grounded antenna arrangement according to claim 2, wherein the conducting ground plane or the PCB comprises a dielectric portion adapted to be located under the, or each, end tip portion, or that a hole is provided in the ground plane under the, or each, end tip portion, to keep the end tip portion or portions isolated from the conducting ground plane.

4. The self-grounded antenna arrangement according to claim 1, wherein the end portion of each antenna petal is conductively connected to the ground plane, and arranged in the vicinity of the antenna feed.

5. The self-grounded antenna arrangement according to claim 1, wherein the end portions each have an end tip portion, said end tip portions further being adapted to be connected to feeding ports, a separate port being provided for each antenna petal comprising an arm section.

6. The self-grounded antenna arrangement according to claim 5, wherein the end tip portion of each antenna petal comprises a small, flat rounded portion.

7. The self-grounded antenna arrangement claim 5, wherein the end tip portion of each antenna petal comprises an opening adapted for reception of a conducting pin that is soldered to the end tip portion of the antenna petal.

8. The self-grounded antenna arrangement according to claim 5, wherein the first connection portions of each antenna petal are soldered or otherwise fixed by screws or pop rivets onto the conducting ground plane or the PCB.

9. The self-grounded antenna arrangement according to claim 5, wherein each antenna petal end tip portion is fed via a conductive pin or wire received in an opening provided in the respective end tip portion.

10. The self-grounded antenna arrangement according to claim 1, wherein each of the end portions are in conductive metal contact with the ground plane close to an edge of an excitation opening, in the ground plane, and wherein at least one antenna feed is arranged within or underneath the excitation opening.

11. The self-grounded antenna arrangement of claim 10, wherein the end portions are arranged in such a way that there is one petal connected to each edge of the array of excitation openings/slots in the ground plane, whereby each opening/slot excites a wave propagating between two neighboring petals similar to the excitation of a so-called TEM horn antenna.

12. The self-grounded antenna arrangement of claim 10, wherein the excitation opening is formed in a rectangular, circular or oval shape.

13. The self-grounded antenna arrangement of claim 10, wherein the excitation opening has an elongate form, and wherein a mid-portion is narrower than end-portions of the excitation opening.

14. The self-grounded antenna arrangement of claim 10, wherein the excitation opening is formed as an etched recess in a PCB, and wherein the antenna feed is arranged on the other side of the PCB.

15. The self-grounded antenna arrangement of claim 10, wherein the antenna feed comprises at least one microstrip, having an end protruding into the bounds of the excitation opening.

16. The self-grounded antenna arrangement of claim 1, wherein the metal surface of each antenna petal is arranged in a curved or bent disposition, forming one or several inclined surface areas in relation to the ground plane.

17. The self-grounded antenna arrangement of claim 16, wherein the metal surface comprises at least one surface area being essentially flat, engageable by pneumatic suction cups.

18. The self-grounded antenna arrangement according to claim 1, wherein the, or at least some, antenna petal or petals of the antenna structure comprises a slot or a slotted structure provided in the first wall portion.

19. The self-grounded antenna arrangement according to claim 1, wherein the antenna petal, or at least some antenna petals of the antenna structure comprises (comprise) a groove formed by the first wall portion and an additional wall portion connecting to the first connection portion at a side opposite the side where the first wall portion is located and extending substantially in parallel with said first wall portion.

20. The self-grounded antenna arrangement according claim 19, wherein the additional wall portion has a length adapted to the length of the first wall portion.

21. The self-grounded antenna arrangement according claim 19, wherein the additional wall portion has a length adapted to the length of an outer side of the conducting ground plane or PCB.

22. The self-grounded antenna arrangement according claim 19, wherein the antenna petal, or at least some antenna petals of the antenna structure, comprises (comprise) one or more slots and a groove formed by the first wall portion and an additional wall portion.

23. The self-grounded antenna arrangement according to claim 1, comprising at least two antenna petals arranged to form antenna structures comprising one or more bowties, and wherein the antenna ports of the antenna petals of a bowtie are adapted to be independently excited.

24. The self-grounded antenna arrangement according to claim 1, comprising at least two antenna petals arranged to form antenna structures comprising one or more bowties, and wherein the antenna ports or feeds of the antenna petals of or associated with one or each bowtie having similarly polarized ports or feeds are excited differentially.

25. The self-grounded antenna arrangement according to claim 24, wherein the antenna ports or feeds of the antenna petals of or associated with one or each bowtie are being connected to and combined by a respective balun, and wherein similarly polarized ports or feeds are excited differentially.

26. The self-grounded antenna arrangement according to claim 1, comprising an antenna structure comprising two antenna petals arranged to form a bowtie comprising two ports or feeds, and wherein the ports or feeds are differentially excited, hence forming a one-port/feed antenna with linear polarization.

27. The self-grounded antenna arrangement according to claim 1, comprising an antenna structure comprising four antenna petals arranged to form a bowtie comprising four ports or feeds, and wherein the similarly polarized ports or feeds are differentially excited, hence forming a two-port/feed antenna with orthogonal linear polarizations.

28. The self-grounded antenna arrangement according to claim 1, comprising an antenna structure comprising a number of antenna petals arranged to form a number, N, of bowties, each comprising four ports or feeds, said bowties being arranged in a linear array, and wherein similarly polarized ports or feeds are differentially excited, hence forming a linear array of N two-port/feed bowties antenna, adapted for use with an 2×N-port/feed Massive MIMO base station or another 2×N-port/feed application.

29. The self-grounded antenna arrangement according to claim 1, comprising an antenna structure comprising a number of antenna petals arranged to form a number, N, of bowties, each comprising four ports or feeds, said bowties being arranged in a planar array, and wherein similarly polarized ports or feeds are differentially excited, hence forming a planar array of N two-port/feed bowties antenna, adapted for use with an 2×N-port/feed Massive MIMO base station or another 2×N-port/feed application.

30. The self-grounded antenna arrangement according to claim 1, comprising at least two antenna petals, forming one or more bowties, and wherein the ports or feeds for each of the antenna petals are substantially uncoupled such that their far field functions are substantially orthogonal in either polarization, direction or shape.

31. The self-grounded antenna arrangement according to claim 1, comprising one antenna petal.

32. The self-grounded antenna arrangement according to claim 1, adapted to be arranged on a mast for a MIMO base station, or for a Massive MIMO base station and wherein it has a MIMO-algorithm-combined radiation pattern covering substantially 4π, i.e. has a spherical coverage or field of view, or that it is adapted to have a MMO-algorithm-combined radiation pattern covering substantially 2π, i.e. has a hemi-spherical coverage, or whatever coverage is specified and can be different in the horizontal and vertical planes.

33. A multiple self-grounded antenna arrangement comprising two or more antenna arrangements according to claim 1, which are arranged adjacent one another substantially in a same plane or along a surface, and wherein they are so arranged with respect to one another that the ports or feeds are arranged on or close to outer side edges of conducting ground planes or PCBs, or on the front or back sides.

34. A method for fabrication of a self-grounded antenna arrangement comprising at least one antenna petal comprising an arm section of an electric, conducting material tapering towards an end portion, wherein the method comprises:

fabricating the antenna petal or antenna petals by punching and pressing each antenna petal in one piece from a sheet of metal;

mounting, using a surface mounting technique, one or more antenna petals in a desired antenna petal structure, forming one or more bowties, onto a base portion comprising conducting ground plane or a PCB;

connecting, by means of conducting wires or pins, the end portions of the one or more antenna petals with antenna feed(s), or connecting the end portions to the conducting ground plane in the vicinity of the feed(s)

the antenna petal comprising a first, planar, connecting portion adapted for connection to the front side of the conducting ground plane or the PCB, a first wall portion forming an angle with the plane in which the first connecting portion extends, and an intermediate mounting portion, further comprising:

punching and pressing each antenna petal to assume a shape, comprising a first, at least partially planar, connecting portion, adapted for connection to the front side of the conducting ground plane or the PCB, a first wall portion forming an angle with the plane in which the first connecting portion extends, an intermediate mounting portion, which is arranged to interconnect said first wall portion with a second wall portion in an opposite end connecting to, or turning into a second connecting portion, including said end portion, disposed in the same plane as the first connecting portion and also being adapted for connection to the base portion.

* * * * *